US012458827B2

(12) United States Patent
Mullen et al.

(10) Patent No.: US 12,458,827 B2
(45) Date of Patent: Nov. 4, 2025

(54) EXERCISE APPARATUS HAVING A STAIR AND SLIDE ASSEMBLY

(71) Applicant: PROSTAIRS FITNESS, LLC, Scituate, MA (US)

(72) Inventors: Richard Mullen, Scituate, MA (US); William Mederios, Bristol, RI (US); Brian A. Woods, Laguna Niguel, CA (US)

(73) Assignee: ProStairs Fitness, LLC, Scituate, MA (US)

( * ) Notice: Subject to any disclaimer, the term of this patent is extended or adjusted under 35 U.S.C. 154(b) by 160 days.

(21) Appl. No.: 18/245,402

(22) PCT Filed: Sep. 15, 2021

(86) PCT No.: PCT/US2021/050432
§ 371 (c)(1),
(2) Date: Mar. 15, 2023

(87) PCT Pub. No.: WO2022/060818
PCT Pub. Date: Mar. 24, 2022

(65) Prior Publication Data

US 2023/0356017 A1 Nov. 9, 2023

Related U.S. Application Data

(60) Provisional application No. 63/078,892, filed on Sep. 15, 2020.

(51) Int. Cl.
*A63B 17/04* (2006.01)
*A63B 71/00* (2006.01)

(52) U.S. Cl.
CPC ..... *A63B 17/04* (2013.01); *A63B 71/0036* (2013.01); *A63B 71/0054* (2013.01); *A63B 2210/50* (2013.01)

(58) Field of Classification Search
CPC . A63B 17/04; A63B 71/0036; A63B 71/0054; A63B 2210/50; A63B 71/0622;
(Continued)

(56) References Cited

U.S. PATENT DOCUMENTS 3,737,161 A * 6/1973 Taylor ..... A63B 9/00 472/137
4,442,920 A * 4/1984 Gronbeck ..... E06C 7/081 182/199

(Continued)

FOREIGN PATENT DOCUMENTS

WO 2022060818 A1 3/2022

*Primary Examiner* — Garrett K Atkinson
(74) *Attorney, Agent, or Firm* — Mintz Levin Cohn Ferris Glovsky and Popeo, P.C.

(57) ABSTRACT

A mobile exercise apparatus includes a plurality of modular exercise components. The plurality of modular exercise components include a platform, a modular stair portion including a plurality of stairs, and a modular slide portion including a slide. The modular stair portion and the modular slide portion are removably coupled to the platform. The mobile exercise apparatus may include a mobile support unit that supports the plurality of modular exercise components, the mobile support unit may be coupled to a vehicle to transport the plurality of modular exercise components.

19 Claims, 27 Drawing Sheets

(58) Field of Classification Search
CPC ..... A63B 69/20; A63B 71/0619; A63B 2009/006; A63B 2071/025; A63B 2071/0655; A63B 2071/0661; A63B 2225/11; A63B 2225/20; A63B 2225/305; A63B 2225/50; A63B 2230/06; G06V 40/23
See application file for complete search history.

(56) References Cited

U.S. PATENT DOCUMENTS 4,747,243 A * 5/1988 Anstead ..... E04F 11/18 52/645
5,330,400 A * 7/1994 Huberman ..... A63B 9/00 482/121
5,554,074 A * 9/1996 Von Parrish ..... A63B 9/00 482/37
D413,957 S * 9/1999 Briggs ..... D21/826
6,019,547 A * 2/2000 Hill ..... A63G 31/007 4/491
6,228,005 B1 * 5/2001 Gray ..... A63B 21/068 482/148
6,443,849 B1 * 9/2002 Byrd ..... A63B 9/00 472/117
6,467,575 B1 * 10/2002 Chen ..... A62B 1/20 182/48
6,569,023 B1 * 5/2003 Briggs ..... A63B 9/00 472/117
D524,897 S * 7/2006 VanDeusen ..... D21/826
9,114,271 B1 * 8/2015 Brown ..... A63B 23/0458
9,206,581 B2 * 12/2015 Mollick ..... A63B 17/04
9,750,999 B2 * 9/2017 Monaco ..... A63B 71/023
9,770,637 B2 * 9/2017 Cranford ..... A63F 3/00529
9,868,069 B2 * 1/2018 Keller ..... A63G 1/14
D809,619 S * 2/2018 Jackson ..... D21/826
D814,589 S * 4/2018 Eroglu ..... D21/826
10,022,635 B2 * 7/2018 Goto ..... A63G 21/02
D844,164 S * 3/2019 Cott ..... D25/1
11,077,329 B2 * 8/2021 Jones ..... A63G 31/00
2013/0090176 A1 * 4/2013 Ochi ..... A63G 31/08 472/29
2015/0217185 A1 * 8/2015 Cranford ..... A63F 3/0423 273/355
2017/0165583 A1 * 6/2017 Keller ..... A63B 9/00

* cited by examiner

EXERCISE APPARATUS HAVING A STAIR AND SLIDE ASSEMBLY

CROSS-REFERENCE TO RELATED APPLICATIONS

The present application is a National Stage Entry of International Patent Application No. PCT/US2021/050432, filed on Sep. 15, 2021, and titled, "EXERCISE APPARATUS HAVING A STAIR AND SLIDE ASSEMBLY," which claims priority to U.S. Provisional Application No. 63/078,892, filed on Sep. 15, 2020, and titled, "EXERCISE APPARATUS HAVING A STAIR AND SLIDE ASSEMBLY," the entirety of each of which is incorporated herein by reference.

BACKGROUND

Exercising by running up and down stairs is a workout often used in training. However, running down stairs can be harmful to the joints in a person's lower body (e.g., knees, hips, etc.) and/or lower back. Further, exercise equipment is often specialized for one type of exercise and may lack customizability and modularity.

SUMMARY

Embodiments herein generally relate to exercise apparatus, components, kits and methods of making and using the same. The various apparatus can include one or more of stairs, a slide, other exercise components and equipment including those described herein, adapters for coupling any of the same to the apparatus. Some embodiments relate to methods of exercise or methods of reducing harm to a joint or body part utilizing the apparatus and/or components described herein. Some embodiments relate to kits for and methods of modifying an existing apparatus to include one or more of the components and apparatus described herein.

One embodiment relates to a stair and slide assembly. The stair and slide assembly includes a stair portion including a plurality of stairs, a slide portion including a slide with an entrance and an exit, and an assist bar positioned proximate the exit of the slide to assist a user with pivoting from the exit of the slide to the stair portion. The slide has a first portion extending substantially linearly from the entrance of the slide at an angle and a second portion extending from the first portion to the exit of the slide. The second portion transitions the slide from the angle of the first portion to substantially horizontal. The exit of the slide is configured to be positioned at a target height above a ground surface. The target height is between about 18 inches and about 30 inches.

Another embodiment relates to an exercise apparatus. The exercise apparatus includes a stair and slide assembly having an upper end and a lower end and a frame assembly positioned to support at least a portion of the stair and slide assembly. The stair and slide assembly includes a stair portion extending from the lower end to the upper end, a slide portion extending from the upper end to the lower end, and a platform positioned at the upper end. The frame assembly includes a first frame portion positioned to support at least one of the lower end of the stair portion and the lower end of the slide portion, a second frame portion positioned to support at least one of the upper end of the stair portion, the upper end of the slide portion, and the platform, and at least one connector beam extending between and connecting the first frame portion and the second frame portion. The second frame portion includes a plurality of legs. One or more of the legs define a plurality of apertures along at least a portion of a length thereof. The plurality of apertures are positioned to facilitate releasably coupling at least one of exercise equipment and storage racks to the frame assembly in various positions.

Still another embodiment relates to an exercise apparatus. The exercise apparatus includes a frame assembly, a stair and slide assembly supported by the frame assembly, and an exercise tracking system. The exercise tracking system includes a sensor and a controller. The sensor is positioned to acquire first user exercise data regarding activity of a user of the exercise apparatus. The controller is configured to receive at least one of the first user exercise data from the sensor and second user exercise data from a wearable device of the user, track the activity of the user based on the at least one of the first user exercise data and the second user exercise data, and provide an indication to the user via at least one of the wearable device, a display, and a speaker system to perform an action to alter the activity of the user to at least one of achieve a user defined goal and maintain the user at an appropriate level of intensity.

The methods can include providing an apparatus as described herein or one or more components as described herein, in any combination, and exercising using the apparatus. For example, providing a set of stairs and a slide and then going up the stairs (running, walking, skipping one or more steps, hopping on 1 or 2 feet, etc.) and going down the slide one or more times. Some embodiments relate to methods of minimizing or reducing harm to one or more joints or to the foot, lower leg, knees, upper leg, hips, etc. by utilizing the apparatus and/or one or more of the components as described herein (in any combination).

As noted above, some embodiments relate to kits for and methods of modifying an existing apparatus to include one or more of the components and apparatus described herein. For example, an existing apparatus having stairs, but no slide or that desires additional slides, can be "retrofitted" or modified to include one or more slides. Some embodiments relate to kits that include a slide and/or hardware and adapters for attaching a slide to an existing stairs apparatus. The methods and kits for such a retrofit can include any of the apparatus, components and parts described herein in any combination. The kits can include platform extensions, vertical and horizontal rails and bars, for example to hold and balance on and for safety, and other parts to prevent falls and for greater safety.

A method of reducing stress or impact to a joint or body part, comprising providing an apparatus or components according to any of embodiments and claims provided herein. The methods can include performing exercise on the apparatus that includes climbing the stairs and descending on the slide multiple times for a set number of repetitions and/or for a predetermined period of time. The period of time can be for example, from about 10 seconds to about 30 minutes, or any sub value or sub range therein, inclusive of the end points. For example, the period of time can be 10 seconds, 15 seconds, 20 seconds, 30 seconds, 40 seconds, seconds, 50 seconds, 60 seconds, 90 seconds, 120 seconds, 3 minutes, 4 minutes, 5 minutes, 6 minutes, 7 minutes, 8 minutes, 9 minutes, 10 minutes, 15 minutes, 20 minutes, 30 minutes, etc., including any sub value or subrange therein. The time interview can be longer, for example 35, 40, 45, 60, 90, 120 minutes, etc. (including sub values and sub ranges therein). For longer time periods, the apparatus can be used at intervals while other exercises are mixed in with other exercises. For example, the entire workout period might be 40 minutes with 5, 10, 15 or 20 minutes being the total amount of time climbing and descending the stairs and slide.

As noted, the exercise could include a set number of cycles up and down. For example, between 1 and 200 cycles, or any sub value or subrange therein. Those cycles can be the total number or the number for each interval when mixing this in with other interval training exercise. The part of the body for which stress or harm can be minimized, includes, but is not limited to a foot, an ankle, a shin, a calf, a knee, a thigh, a hip, the back, including all related soft tissue, muscles and joints. The methods can include methods of rehabilitating or strengthening an injury or weakness of any of the parts of the body, including those listed above. The embodiments can include the selection of a person that is susceptible to or has been identified as having an injury, needing to avoid injury to or that is rehabilitating and injury, to any of the body parts listed above and described herein.

The foregoing summary is illustrative only and is not intended to be in any way limiting. In addition to the illustrative aspects, embodiments, and features described above, further aspects, embodiments, and features will become apparent by reference to the drawings and the following detailed description.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings, The drawings are provided to illustrate example embodiments described herein and are not intended to limit the scope of the disclosure. Throughout the drawings, reference numbers may be re-used to indicate general correspondence between referenced elements.

When practical, similar reference numbers denote similar structures, features, or elements.

DETAILED DESCRIPTION

Figure 1:
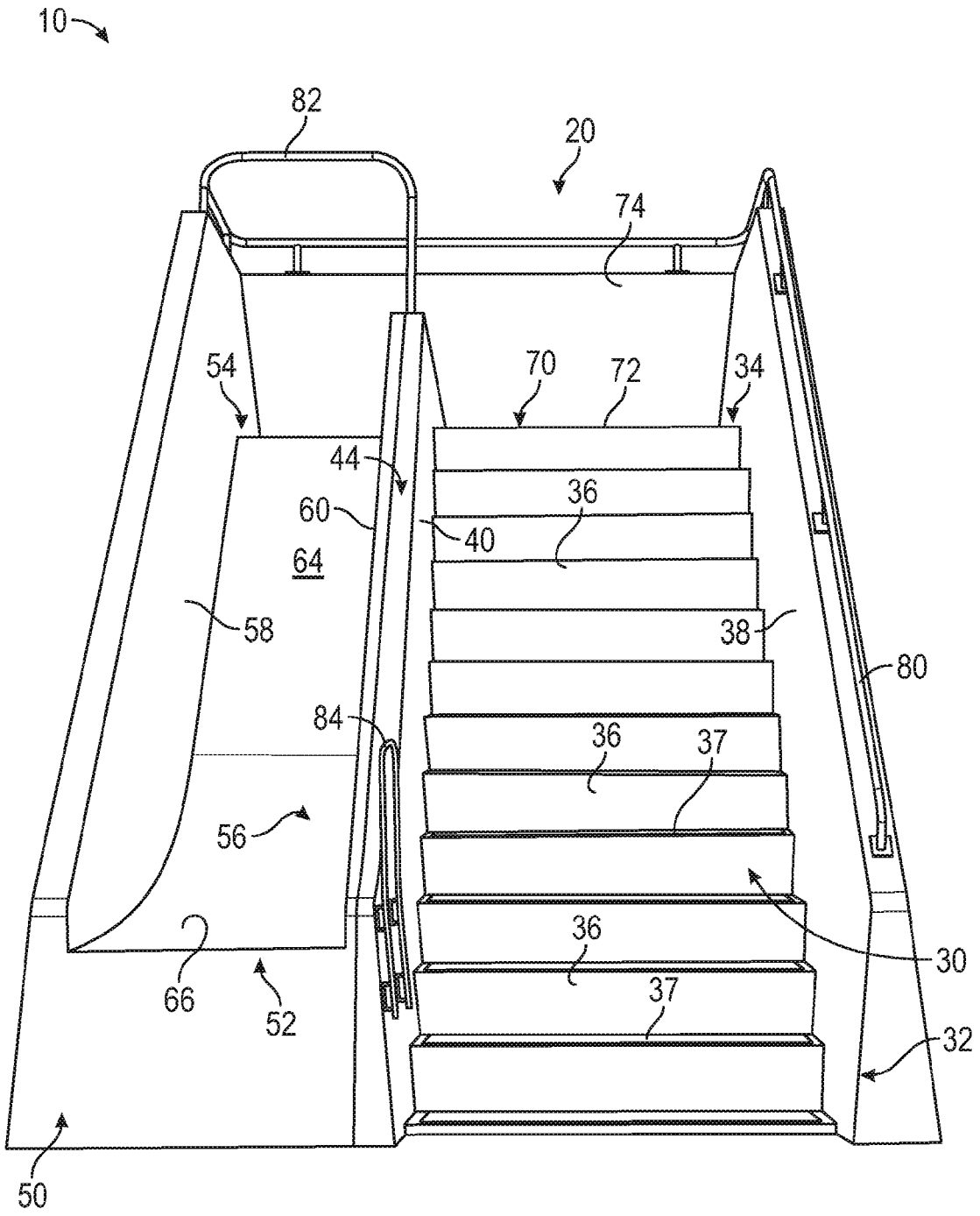
FIG. 1 is a front view of an exercise apparatus, according to an example embodiment.

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is defined by the claims that follow this description and not by any particular embodiment described herein. Before turning to the figures, which illustrate example embodiments in detail, it should be understood that the application is not limited to the details or methodology set forth in the description or illustrated in the figures. It should also be understood that the terminology is for the purpose of description only and should not be regarded as limiting.

According to the example embodiment shown in FIGS. 1-37, a multipurpose training exercise apparatus, shown as exercise apparatus 10, is configured to facilitate various types of exercise activities and training. By way of example, the exercise apparatus 10 may facilitate endurance training, cardiovascular training, strength training, flexibility training, cross-fit training, aerobic activity, anaerobic activity, stretching activity, and/or still other types of exercise activities and training. According to an example embodiment, the exercise apparatus 10 is configured to provide a highly modular and user-customizable exercise apparatus to meet the various needs required of each individual unit (e.g., various components of the exercise apparatus 10 may be relocated, removed, replaced, changed, customized, etc. to facilitate tailoring the exercise apparatus 10 to the specific needs of a respective owner and/or user). The modularity of the exercise apparatus allows the apparatus to be highly customizable and re-configurable to allow the apparatus to be used in a variety of locations, including indoors, such as at a gym facility, outdoors, such as in a backyard, and/or at other locations. As discussed in more detail below, the exercise apparatus may include various modular components, such as a stair and slide assembly, a frame assembly, and/or the like. Each of these modular components may be formed of one, two, three, four, five, or more subcomponents and/or subassemblies to further improve the storability, transportability, ability to carry, ability to arrange and/or rearrange and/or usability of the exercise apparatus.

The modularity of the exercise apparatus may also allow the apparatus to be portable such that the apparatus (or its components) can be easily transported and/or once assembled, be broken down into modular components and easily transported. The modular components of the exercise apparatus may be easily stored and/or transported to various locations, where the exercise apparatus may be assembled, re-assembled, configured in a suitable manner depending on the location, and/or be used if the exercise apparatus is already assembled when transported.

The modularity of the exercise apparatus may also allow the exercise apparatus to fit through small spaces. For example, when transporting the exercise apparatus into and/or out of an indoor facility, such as a gym, the facility may not need a loading dock to transport the components into the facility. Instead, the modular components may be easily moved into an indoor facility through the doors (e.g., a standard size doorway) of the facility, and/or an outdoor facility through a gate or other small space.

As noted above, the exercise apparatus may be easily moved due at least in part to the modularity of the exercise apparatus. The modular components of the exercise apparatus may also be sized and/or shaped to allow the exercise apparatus to be more easily carried and/or stored during transportation. For example, the modular components may be sized and/or shaped to fit within a trailer (e.g., a trailer that can be towed by a vehicle, such as a car, truck, and/or the like). In some implementations of the current subject matter, the modular components may be stackable to reduce the amount of space each of the components occupies during transportation. Additionally and/or alternatively, the modular components may be sized and/or shaped to fit within one or more crates, which in some instances, may be carried by a user and/or easily transported by a single user, for example. To improve the portability of the exercise apparatus, one or more of the modular components of the exercise apparatus may include one or more wheels, among other portability features.

Additionally and/or alternatively, the exercise apparatus may include one or more lightweight materials. For example, one or more components of the exercise apparatus may be made of metal, fiberglass, plastic, composite material, cloth, mesh, and/or the like. This allows each of the modular components of the exercise apparatus to be more easily assembled, disassembled, carried, transported, and/or the like.

In some implementations of the current subject matter, the exercise apparatus may be a standalone unit such that additional supports and/or equipment is not used to support the exercise apparatus in use. For example, the exercise apparatus may be configured to be supported by a support structure that rests on the ground. Additionally and/or alternatively, the exercise apparatus may be supported by a mobile support unit, such as a vehicle, a trailer coupleable and/or towable by a vehicle, and/or another moveable support unit. Such configurations may allow for the exercise apparatus to be assembled at a variety of locations, such as outdoor and/or indoor locations, and/or be easily transported from one location to another. This may also allow for the exercise apparatus to be used as a mobile system that can either be assembled, disassembled, and transported to and/or from various locations, and/or be supported by a mobile support unit. For example, when the exercise apparatus is supported by the mobile support unit described herein, the exercise apparatus may not be disassembled when transported from one location to another. Instead, the exercise apparatus may be assembled and supported by the mobile support unit. When supported by the mobile support unit, the exercise apparatus may be transported from one location to another without disassembling the exercise apparatus. Thus, consistent with implementations of the current subject matter, the exercise apparatus may be supported by the mobile support unit and transported in an assembled configuration from one location to another. This allows the exercise apparatus to be more easily used and moved from one location to another. Additionally and/or alternatively, as described herein, the exercise apparatus may be disassembled and stored within and/or transported within the mobile support unit.

As noted above, the exercise apparatus may be configured to fit in a variety of locations. In other words, the modular components of the exercise apparatus may be assembled in one or more alignment configurations. For example, as discussed in more detail below with respect to FIGS. 31-37, one or more components of the exercise apparatus such as the slide apparatus and/or the stair apparatus of the exercise apparatus may be positioned at various angles (e.g., parallel, perpendicular, at 0 degrees, at 45 degrees, at 90 degrees, at 135 degrees, at 180 degrees, and/or the like) relative to one another. This allows the exercise apparatus to fit the space requirements of the location at which the exercise apparatus is assembled. For example, the exercise apparatus may be transported into and/or assembled at an indoor facility, such as a gym, that already has a set layout with other equipment. Consistent with implementations of the current subject matter, the modular components of the exercise apparatus may be assembled a variety of configurations to account for preexisting structures, equipment, and/or layout plans. This allows the exercise apparatus to be more conveniently used in various locations. As another example, the exercise apparatus may assembled in the various alignment configurations described herein to provide a user with different types of workout options and/or to account for the number of users using the exercise apparatus. Additionally and/or alternatively, the exercise apparatus may be configured to include one or more of the subassemblies, such as the slide apparatus, the stair apparatus, the platform, and/or the like in various arrangements.

Figure 2:
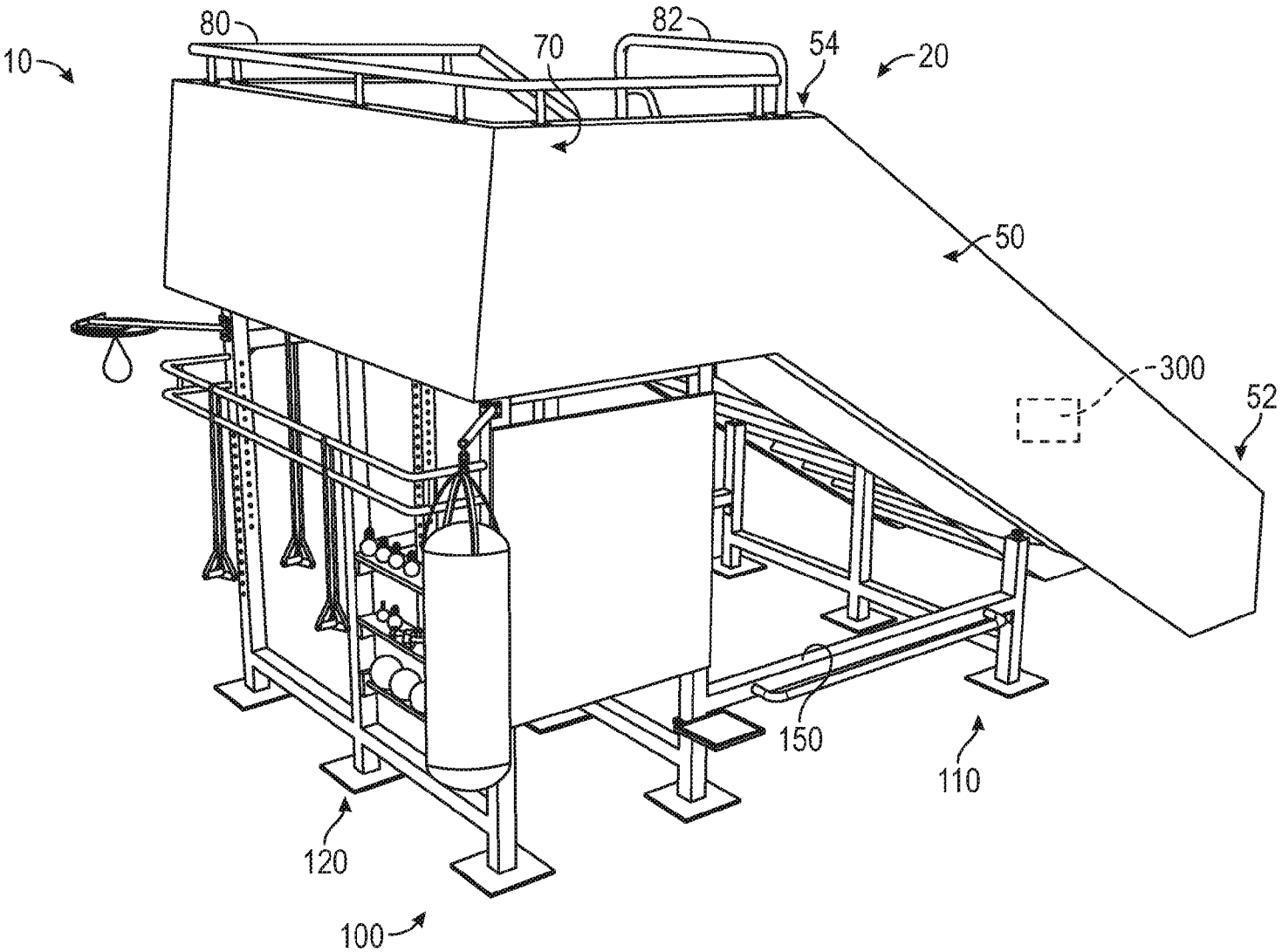
FIGS. 2 and 3 are various perspective views of the exercise apparatus of FIG. 1, according to an example embodiment.
Figure 3:
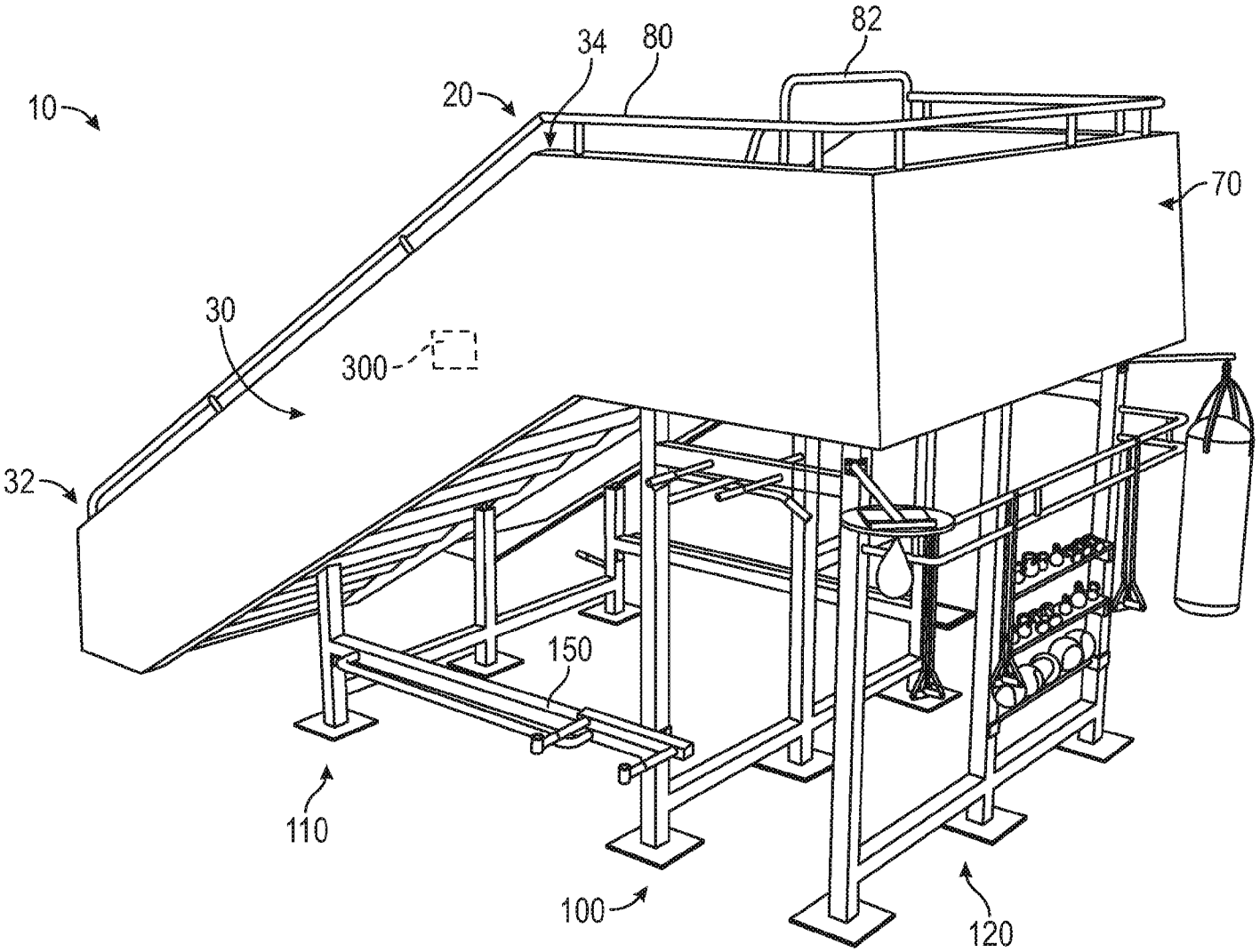
Figure 4:
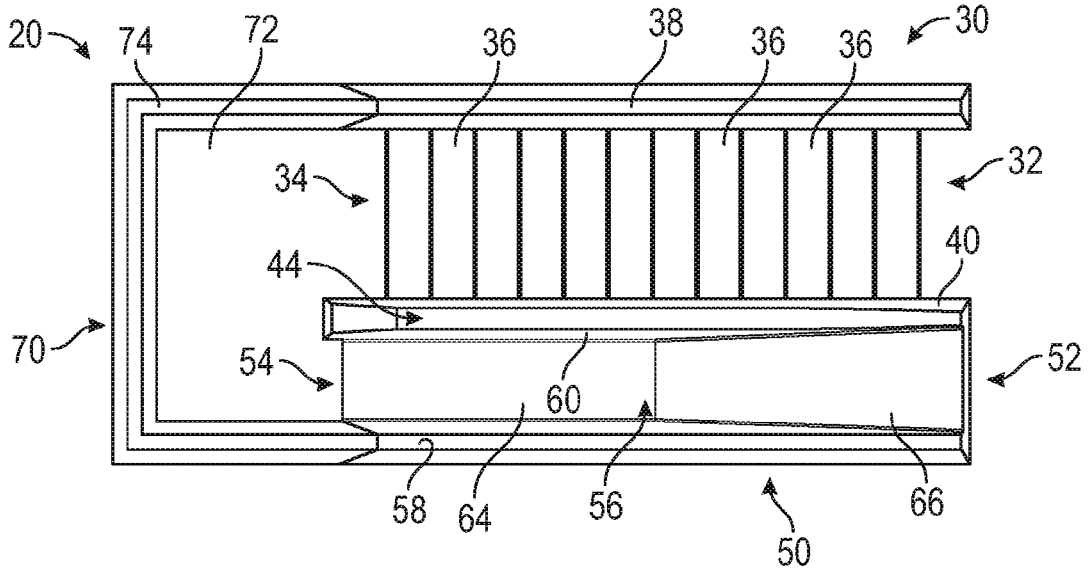
FIGS. 4 and 5 are various views of a stair and slide assembly of the exercise apparatus of FIG. 1, according to an example embodiment.
Figure 5:
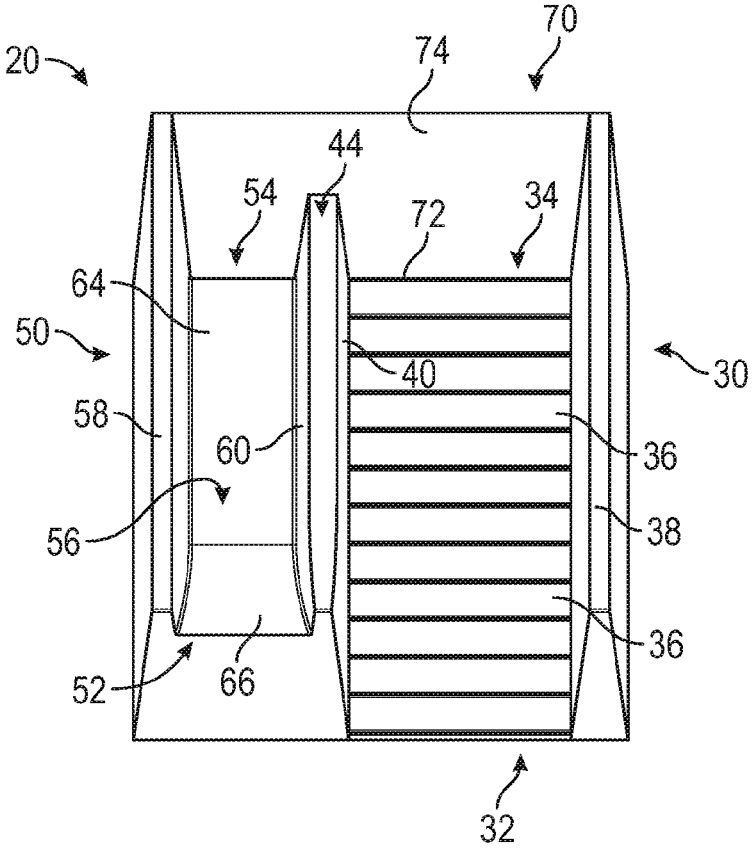
Figure 6:
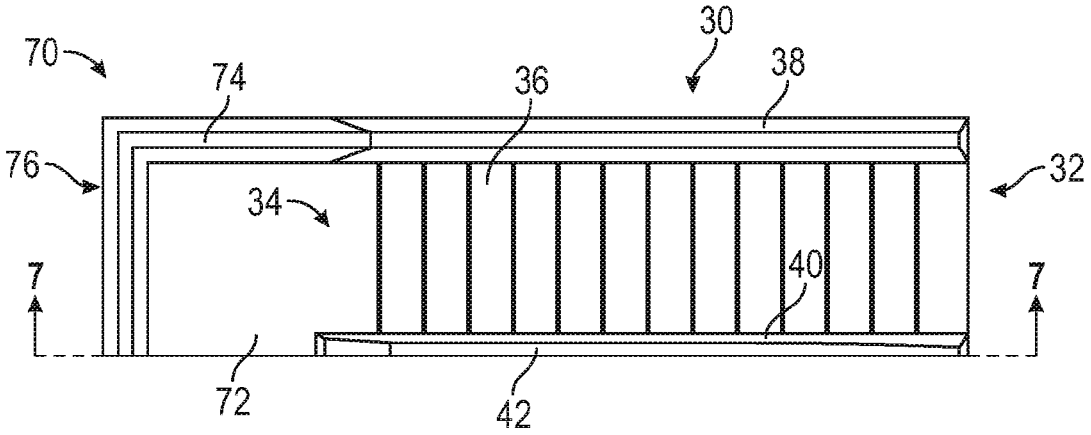
FIGS. 6-8 are various views of a stair apparatus of the stair and slide assembly of FIGS. 4 and 5, according to an example embodiment.
Figure 7:
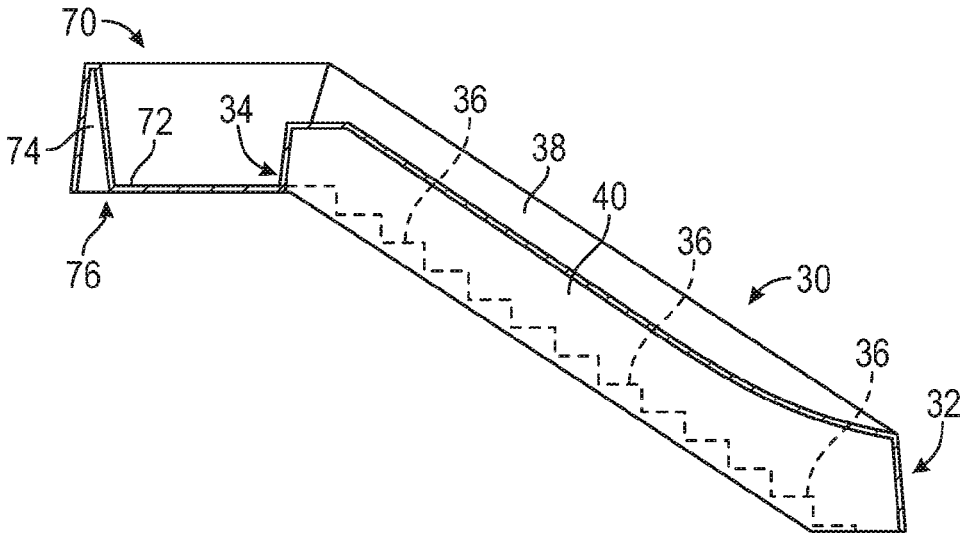
Figure 8:
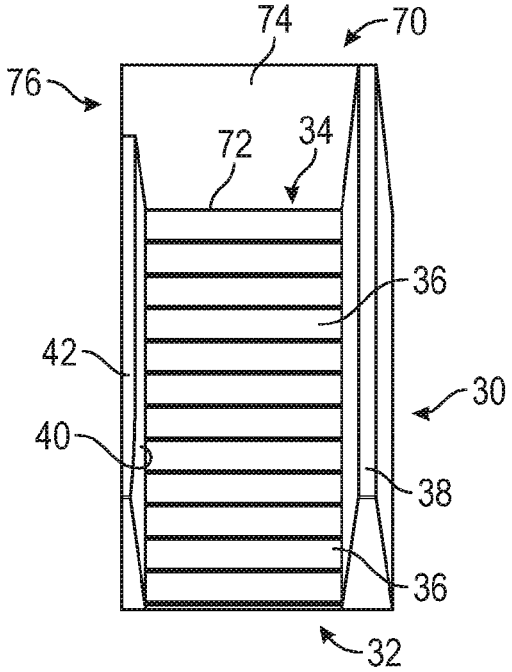

As shown in FIGS. 1-3, the exercise apparatus 10 includes a first assembly, shown as stair and slide assembly 20, supported by a second assembly, shown as frame assembly 100, and a control system, shown as exercise tracking system 300. As shown in FIGS. 1-11, the stair and slide assembly 20 includes a first portion, shown as stair apparatus 30, a second portion, shown as slide apparatus 50, and a third portion, shown as platform 70. As shown in FIGS. 1 and 3-8, the stair apparatus 30 has a first end, shown as bottom end 32; an opposing second end, shown as top end 34; a first wall, shown as outer wall 38; a second wall, shown as inner wall 40, spaced from the outer wall 38; and a plurality of steps, shown as steps 36, extending between the outer wall 38 and the inner wall 40 from the bottom end 32 to the top end 34. As shown in FIGS. 6 and 8, the inner wall 40 has a flange, shown as lip 42, extending therefrom and along a longitudinal length of the inner wall 40.

Figure 9:
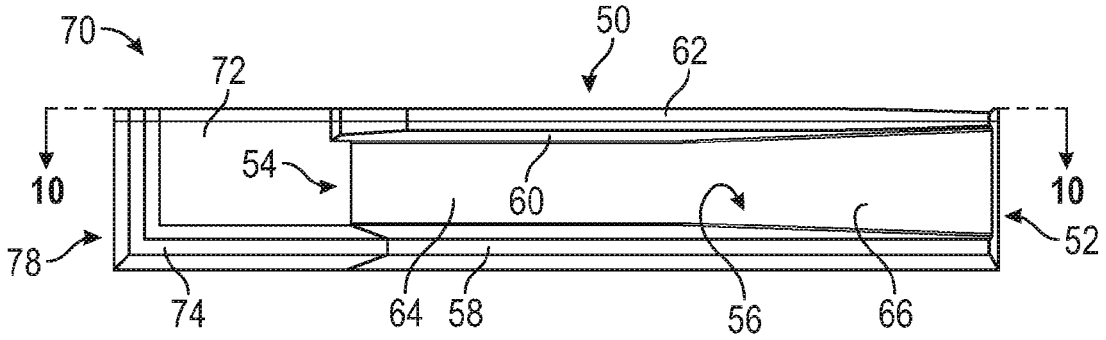
FIGS. 9-11 are various views of a slide apparatus of the stair and slide assembly of FIGS. 4 and 5, according to an example embodiment.
Figure 10:
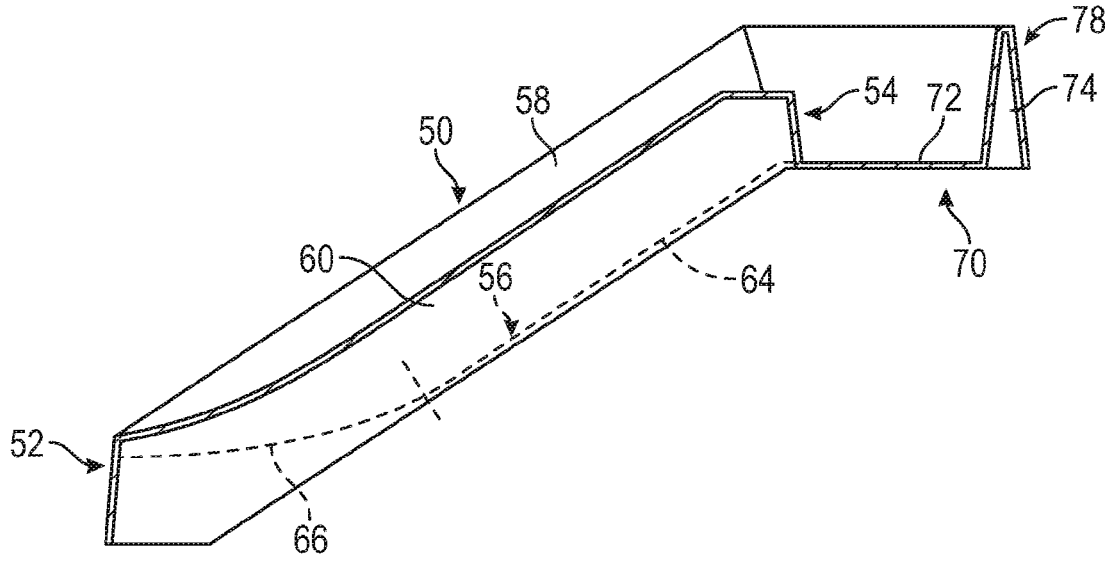
Figure 11:
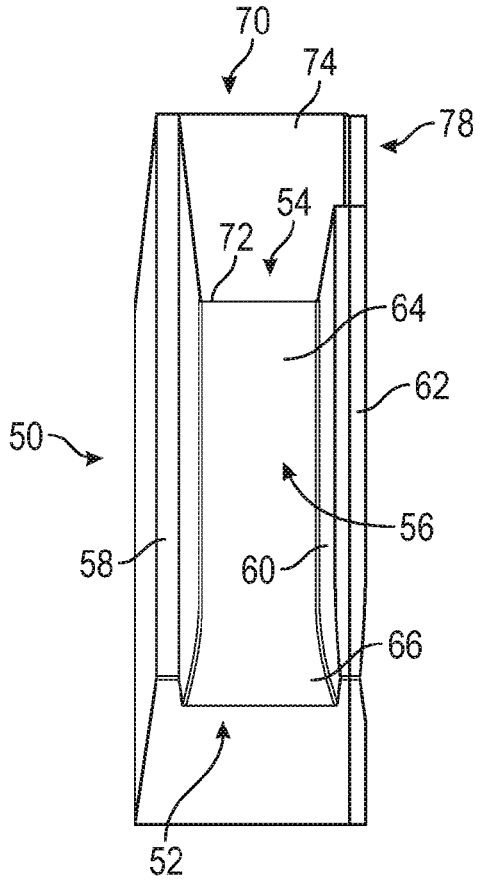
Figure 12:
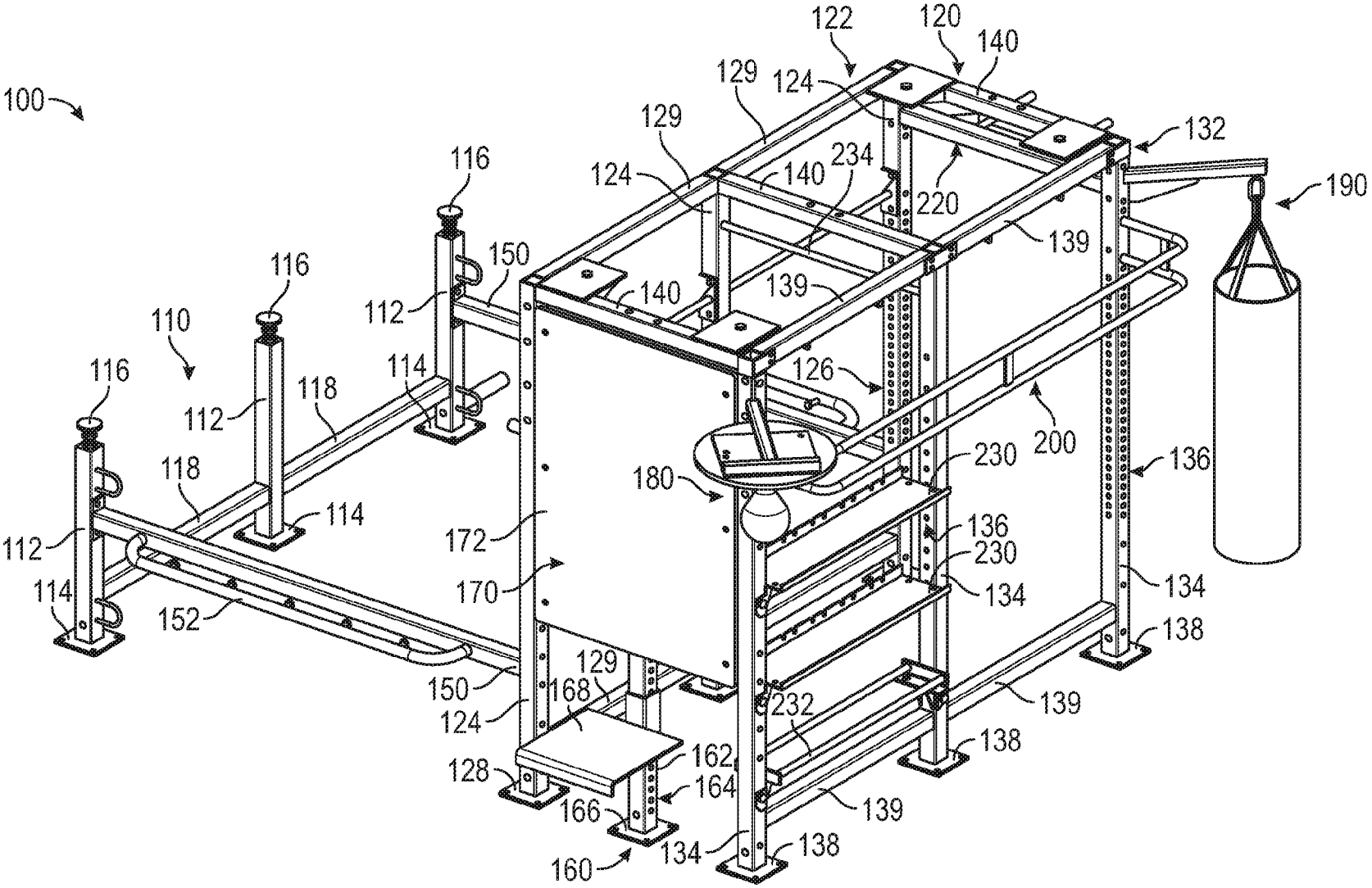
FIGS. 12-20 are various views of a frame assembly and components thereof of the exercise apparatus of FIG. 1, according to an example embodiment.
Figure 13:
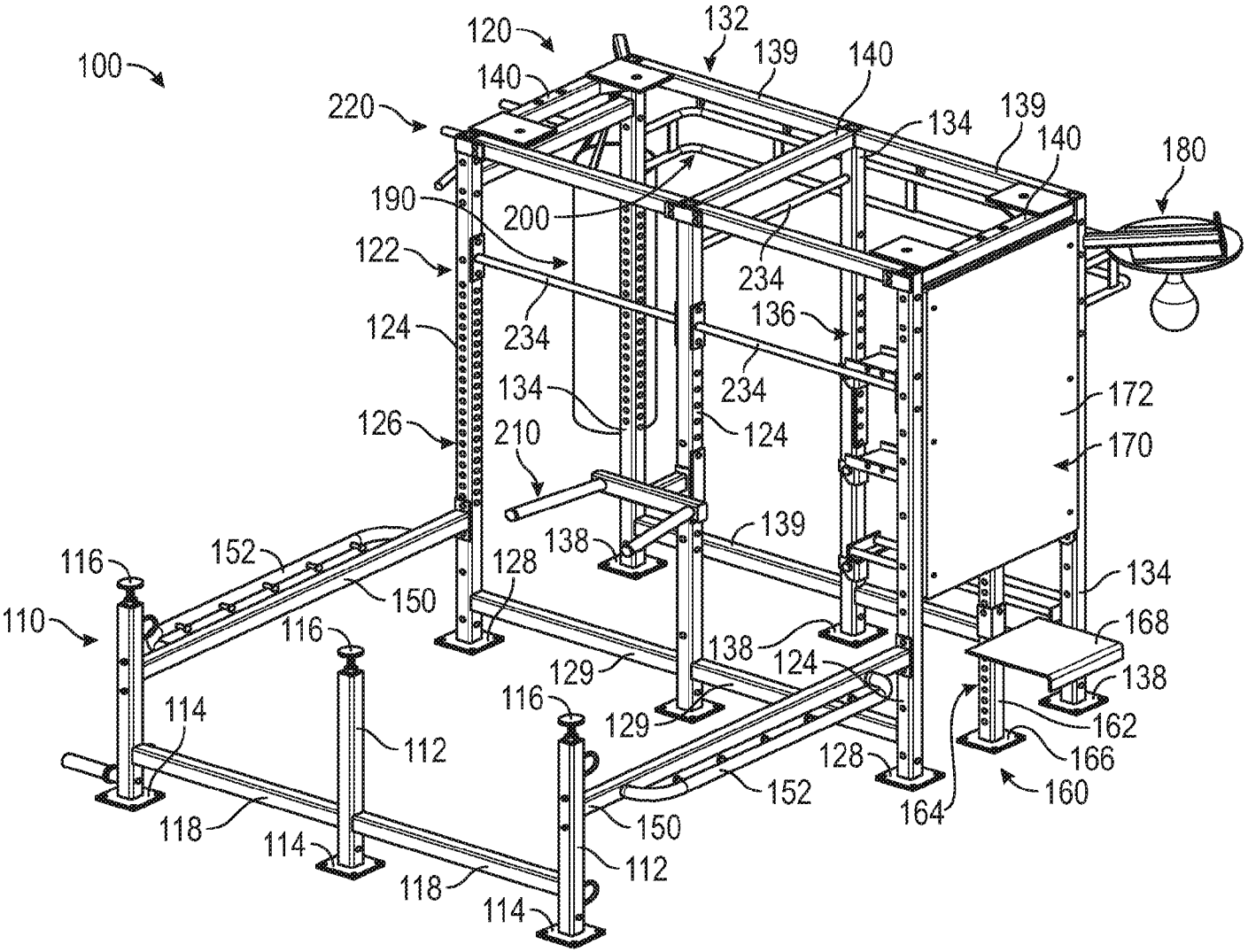

As shown in FIGS. 1,2,4,5, and 9-11, the slide apparatus 50 has a first end, shown as bottom end 52; an opposing second end, shown as top end 54; a first wall, shown as outer wall 58; a second wall, shown as inner wall 60, spaced from the outer wall 58; and a slide, shown as slide 56, extending between the outer wall 58 and the inner wall 60 from the bottom end 52 to the top end 54. As shown in FIGS. 9 and 11, the inner wall 60 has an interface, shown as groove 62, defined along a longitudinal length of the inner wall 60.

As shown in FIGS. 1 and 4-11, the platform 70 includes a support surface, shown as deck 72, and a peripheral wall, shown as platform wall 74, extending around the periphery of the deck 72. As shown in FIGS. 6-11, the platform 70 has a two-piece construction including a first portion, shown as stair portion 76, coupled to the top end 34 of the stair apparatus 30, and a second portion, shown as slide portion 78 coupled to the top end 54 of the slide apparatus 50. In other embodiments, the platform 70 has a mono-piece construction. In some embodiments, the stair portion 76 of the platform 70 and the stair apparatus 30 are manufactured as a single (e.g., integral, unitary, etc.) component. In some embodiments, the stair portion 76 of the platform 70 and the stair apparatus 30 are manufactured as individual components that are thereafter secured together (e.g., with fasteners, adhesive, welded, etc.). In some embodiments, the slide portion 78 of the platform 70 and the slide apparatus 50 are manufactured as a single (e.g., integral, unitary, etc.) component. In some embodiment, the slide portion 78 of the platform 70 and the slide apparatus 50 are manufactured as individual components that are thereafter secured together (e.g., with fasteners, adhesive, welded, etc.).

In one embodiment, the stair and slide assembly 20 has a two-piece construction such that (i) the stair apparatus 30 and the stair portion 76 of the platform 70 and (ii) the slide apparatus 50 and the slide portion 78 of platform 70 are configured to couple together (e.g., with fasteners, adhesive, welded, etc.) such that the lip 42 of the inner wall 40 of the stair apparatus 30 engages with the groove 62 of the inner wall 60 of the slide apparatus 50, thereby forming the stair and slide assembly 20. As shown in FIGS. 1, 4, and 5, the inner wall 40 of the stair apparatus 30 and the inner wall 60 of the slide apparatus 50 cooperatively form a center wall, shown as dividing wall 44, positioned to separate the steps 36 from the slide 56.

In other embodiments, the stair and slide assembly 20 has a mono-piece construction such that the stair apparatus 30, the slide apparatus 50, and the platform 70 are manufactured as a single (e.g., integral, unitary, etc.) component. In still other embodiments, the stair apparatus 30 and the slide apparatus 50 are manufactured as a first, unitary component and the platform 70 is manufactured as a second, unitary component that is coupled to stair apparatus 30 and the slide apparatus 50 to form the stair and slide assembly 20. In yet other embodiments, the stair and slide assembly 20 has a three-piece construction such that the stair apparatus 30, the slide apparatus 50, and the platform 70 are each individual components that are coupled together to form the stair and slide assembly 20. In yet still other embodiments, the stair and slide assembly 20 has a four-piece construction such that the stair apparatus 30, the slide apparatus 50, the stair portion 76 of the platform 70, and the slide portion 78 of the platform 70 are each individual components that are coupled together to form the stair and slide assembly 20. And in yet still other embodiments, the stair and slide assembly 20 has a five-piece construction such that the stair apparatus 30 and the slide apparatus 50 are each split into two individual components that are configured to couple together (e.g., with fasteners, adhesive, welded, etc.) to form a complete stair apparatus 30 and slide apparatus 50, which are then coupled together and coupled to the platform 70 to form the stair and slide assembly 20. It will also be foreseeable to one of ordinary skill in the art to make further multi-piece constructions like the five-piece construction by selectively dividing the stair apparatus 30, slide apparatus 50 and platform 70 into multiple components for manufacturing that are subsequently coupled together (e.g., with fasteners, adhesive, welded, etc.) to form the stair and slide assembly 20. In yet another embodiment, the stair and slide assembly 20 has another five-piece construction such that the stair apparatus 30, the slide apparatus 50, the platform 70 and separate pieces that are coupled together along with left and right panels 300 to form the assembly 20.

As shown in FIGS. 1-5, the stair apparatus 30 is positioned on the right side of the stair and slide assembly 20 and the slide apparatus 50 is positioned on the left side of the stair and slide assembly 20. In some embodiments, the stair apparatus 30 is positioned on the left side of the stair and slide assembly 20 and the slide apparatus 50 is positioned on the right side of the stair and slide assembly 20. According to an example embodiment, the stair apparatus 30, the slide apparatus 50, and/or the platform 70 are at least partially manufactured from fiberglass. In some embodiments, the stair apparatus 30, the slide apparatus 50, and the platform 70 (e.g., side panels thereof, etc.) are at least partially manufactured from a plastic material, a polymer material, a composite material (e.g., carbon fiber, etc.), a metal material (e.g., aluminum, steel, etc.), and/or any other suitable materials. According to an example embodiment, the material of the stair and slide assembly 20 is denser and thicker than traditional slides as the stair and slide assembly 20 is designed to bear the weight and high impact forces of adults repeatedly running up the stair apparatus 30 and throwing themselves down the slide 56 during intense workout and training. According to an example embodiment, the stair apparatus 30, the slide apparatus 50, and/or the platform 70 are stackable such that a plurality of stair and slide assemblies 20 may be shipped economically in bulk.

As shown in FIG. 1, the steps 36 each include an impact mitigating material (e.g., rubber, padded portions, etc.), shown as strips 37, disposed along the width thereof. According to an example embodiment, the strips 37 are configured to increase traction for a user and/or reduce impact forces on the knees, joints, etc. of the user as the user ascends the steps 36 (e.g., runs, walks, etc.) from the bottom end 32 to the top end 34 of the stair apparatus to the deck 72 of the platform 70. According to the example embodiment shown in FIGS. 1 and 4-8, the stair apparatus 30 includes thirteen steps 36. In some embodiments, the stair apparatus 30 includes a different number of steps 36 (e.g., more than 13 steps, less than 13 steps, any number of steps between 3 and 25 steps, etc.). Each of the steps 36 may have a predefined height and/or a predefined depth. Accordingly, a target footprint of the stair apparatus 30 (e.g., the overall size, etc.) may be provided by selectively adjusting (i) the height and/or depth of each of the steps 36 and/or (ii) the number of steps 36. By way of example, the stair apparatus 30 may have smaller footprint by reducing the number of steps 36, reducing the height of each step 36, and/or reducing the depth of each step 36.

According to an example embodiment, the steps 36 range from two feet to eight feet wide. In some embodiments, the steps 36 are greater than eight feet wide (e.g., ten feet, twelve feet, etc.). In one embodiment, the steps 36 are wide enough for users to ascend the stair apparatus 30 in a single file line (e.g., two to four feet wide, etc.). In another embodiment, the steps 36 are wide enough for two or three users to ascend the stair apparatus side by side (e.g., in a race, four feet to eight feet wide, etc.). In some embodiments, the steps 36 are spaced between the bottom end 32 and the top end 34 of the stair apparatus 30 in a single-stride step arrangement. In some embodiments, the steps 36 are spaced between the bottom end 32 and the top end 34 of the stair apparatus 30 in a double-stride step arrangement. In some embodiments, a first half (e.g., a left half, a right half, etc.) of the steps 36 are spaced between the bottom end 32 and the top end 34 of the stair apparatus 30 in a single-stride step arrangement and a second half (e.g., a right half, a left half, etc.) of the steps 36 are spaced between the bottom end 32 and the top end 34 of the stair apparatus 30 in a double-stride step arrangement. In some embodiments, the steps 36 are reconfigurable between a single-stride step arrangement and a double-stride step arrangement (e.g., individual steps 36 may be capable of being selectively dropped, raised, lowered, etc. such that stride lengths can be selectively set by the user).

As shown in FIGS. 1-3, the stair and slide assembly 20 includes a railing, shown as handrail 80 that extends along the outer wall 38 of the stair apparatus 30 and the platform wall 74 of the platform 70. The handrail 80 is positioned to provide increased stability to the user as he or she ascends the stair apparatus 30 to the platform 70 and then to the slide apparatus 50. As shown in FIGS. 1-3, the stair and slide assembly 20 includes a first assist bar (e.g., a U-shaped bar, etc.), shown as upper assist bar 82, positioned at the top end 54 of the slide apparatus 50, extending from the outer wall 58 of the slide apparatus 50 to the dividing wall 44. According to an example embodiment, the upper assist bar 82 is positioned above the entrance of the slide apparatus 50 to assist the user in entering and sliding down the slide 56. As shown in FIG. 1, the stair and slide assembly 20 includes a second assist bar (e.g., a U-shaped handle, etc.), shown as lower assist bar 84, positioned at the bottom end 52 of the slide apparatus 50, extending from the dividing wall 44. According to an example embodiment, the lower assist bar 84 is positioned at the exit of the slide apparatus 50 to assist the user exiting the slide 56 in swinging around from the slide apparatus 50 to the stair apparatus 30 to begin ascending the steps 36 another time.

As shown in FIGS. 1, 4, 5, and 9-11, the slide 56 includes a first portion (e.g., an upper portion, etc.), shown as main portion 64, and a second portion (e.g., a lower portion, etc.), shown as landing portion 66. According to the example embodiment shown in FIG. 10, the main portion 64 of the slide 56 is substantially linear and extends at an angle (e.g., 30, 35, 40, 45, 50, 55, 60, etc. degrees) such that the user may expeditiously descend from the deck 72 down the slide 56 without having to run or walk down a flight of stairs (e.g., which is better for the knees and joints, etc.). According to the example embodiment shown in FIG. 10, the landing portion 66 of the slide 56 includes a transition or curved portion and a horizontal portion. The curved portion transitions the slide 56 from the angle of the main portion 64 to substantially horizontal at the horizontal portion (e.g., the landing portion 66 is non-linear, etc.). Such a substantially horizontal arrangement of the landing portion 66 may sufficiently slow the user as the user approaches the bottom end 52 of the slide apparatus 50 to facilitate safely exiting the slide 56. The landing portion 66 of the slide 56 may have any length in the range from two feet to ten feet (e.g., two, three, four, five, six, seven, eight, nine, ten, etc. feet). In some embodiments, the landing portion 66 of the slide 56 has a length between four feet and eight feet.

According to an example embodiment, the horizontal portion of the landing portion 66 of the slide 56 extends between 18 inches and 60 inches (e.g., from the end of the curved portion of the landing portion 66 to the exit of the slide 56 at the bottom end 52 thereof, etc.). In one embodiment, the horizontal portion of the landing portion 66 extends about 30 inches. In other embodiments, the horizontal portion of the landing portion 66 extends about 18 inches, 24 inches, 36 inches, 42 inches, 48 inches, 54 inches, 60 inches, or any length there between. The length of the horizontal portion of the landing portion 66 may be dependent on the angle of descent of the main portion 64 (e.g., the steeper the angle of descent, the longer the horizontal portion of the landing portion 66 may be, etc.). The angle of descent of the main portion 64 and the length of the horizontal portion of the landing portion 66 may be selected such the slide 56 slows the speed of descent of a user thereof, but not so much that the user stops. The user may therefore maintain sufficient momentum at the exit of the slide 56 to assist in turning and running up the stair apparatus 30.

According to an example embodiment, the landing portion 66 at the bottom end 52 of the slide 56 (e.g., the exit of the slide 56, etc.) is at a height of between 12 inches and 36 inches above the ground surface. In some embodiments, the height of the exit of the slide 56 is between 18 inches and 30 inches. In some embodiments, the height of the exit of the slide 56 is between 12 inches and 24 inches. In some embodiments, the height of the exit of the slide 56 is between 18 inches and 24 inches. By way of example, the exit of the slide 56 may be designed to be approximately knee high on an average adult male, an average adult female, and/or an average child. The height of the exit of the slide 56 may be predefined based on the intended use of the exercise apparatus 10 (e.g., for adult use, child use, male use, female use, etc.). The height of the exit of the slide 56 being approximately knee high may advantageously facilitate a user with quickly getting to a standing position once reaching the bottom of the slide 56 (e.g., the user does not exit the slide 56 in a squatting position, etc.). Therefore, the increased height of the exit of the slide 56 and the lower assist bar 84 may facilitate a user with immediately standing, pivoting, and running up the stair apparatus 30 after descending the slide apparatus 50 (e.g., to maintain a target heart rate, speed, etc.).

As shown in FIGS. 2, 3, 12-17 and 20, the frame assembly 100 includes a first frame portion, shown as short frame 110; a second frame portion, shown as tall frame 120; and a plurality of connectors (e.g., two, three, etc.), shown as connector beams 150, extending between the short frame 110 and the tall frame 120, coupling the two together. In some embodiments, a first end of the connector beams 150 is releasably secured (e.g., fastened, bolted, etc.) to the short frame 110 and/or an opposing second end of the connector beams 150 is releasably secured to the tall frame 120. In some embodiments, the first end of the connector beams 150 is fixedly secured (e.g., welded, etc.) to the short frame 110 and/or the opposing second end of the connector beams 150 is fixedly secured to the tall frame 120. According to an example embodiment, the short frame 110, the tall frame 120, and the connector beams 150 are manufactured from an industrial, high strength, durable material (e.g., high strength steel, etc.) that can withstand excessive force and wear from heavy lifting, heavy weight, and high impact forces.

As shown in FIGS. 12-15 and 20, the short frame 110 includes a first plurality of legs (e.g., two, three, four, five, etc.), shown as short legs 112. Each of the short legs 112 has a base plate, shown as foot plate 114, coupled to a first end (e.g., a lower end, a bottom end, etc.) of each of the short legs 112 and an adjuster, shown as adjustable foot 116, movably coupled (e.g., threadably coupled, slidably coupled, etc.) to an opposing second end (e.g., an upper end, a top end, etc.) of each of the short legs 112. The foot plates 114 may increase the stability of the short frame 110. In some embodiments, the foot plates 114 define a plurality of apertures that are configured to receive fasteners (e.g., bolts, etc.) such that the short frame 110 may be secured (e.g., anchored, etc.) to a ground surface. The adjustable feet 116 may facilitate selectively adjusting (e.g., decreasing, increasing, etc.) the height of the short legs 112. In other embodiments, the adjustable feet 116 are coupled to the first end of the short legs 112. As shown in FIGS. 12-15 and 20, the short frame 110 includes a first plurality of connectors, shown as cross-beams 118, connecting the short legs 112 to each other. In some embodiments, the short legs 112 and the cross-beams 118 are welded together. In some embodiments, the short legs 112 and the cross-beams 118 are fastened together (e.g., with bolts, etc.).

Figure 21:
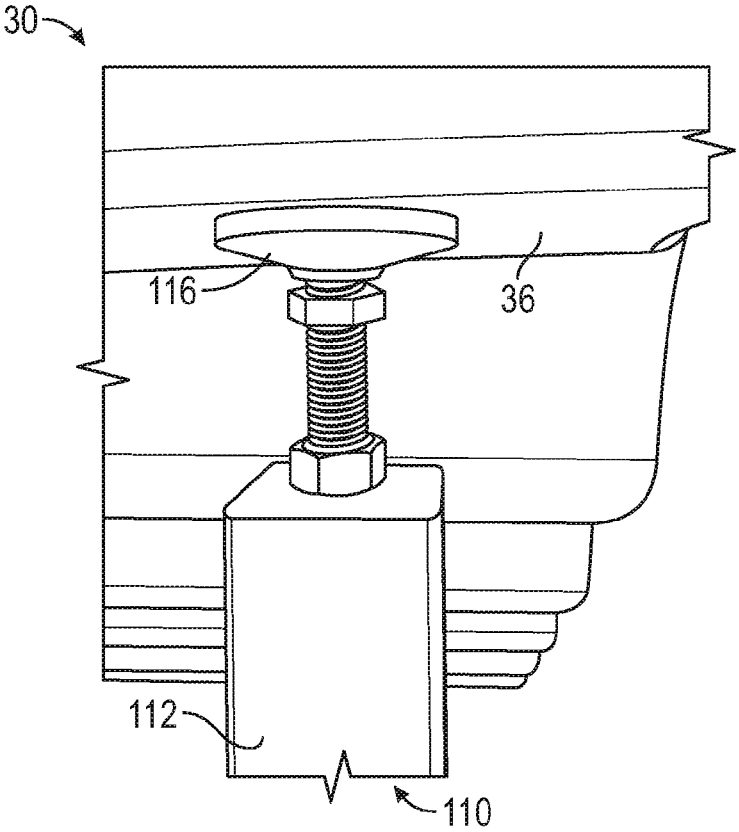
FIGS. 21-24 are various views of a height adjustment mechanism of the exercise apparatus of FIG. 1, according to an example embodiment.
Figure 22:
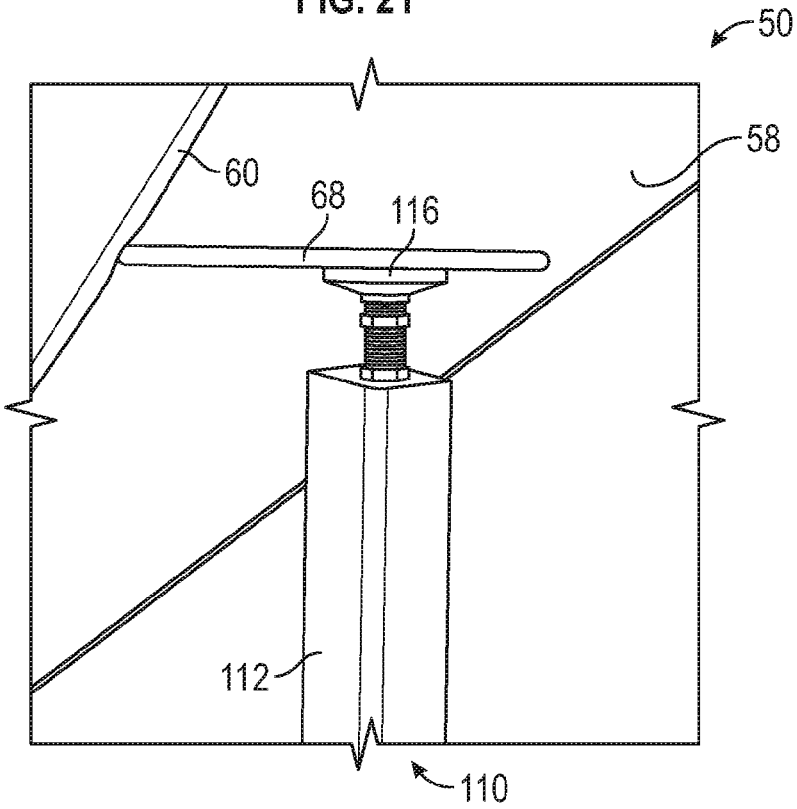

As shown in FIGS. 2 and 3, the short frame 110 is positioned to engage with and support the stair apparatus 30 and the slide apparatus 50 of the stair and slide assembly 20, proximate (e.g., near, close to, within one to ten feet of, etc.) the bottom end 32 of the stair apparatus 30 and the bottom end 52 of the slide apparatus 50. As shown in FIG. 21, one or more of the adjustable feet 116 are positioned and configured to engage with the underside of one of the steps 36 to support the bottom end 32 of the stair apparatus 30. As shown in FIG. 22, the slide apparatus 50 includes a bar, shown as slide support bar 68, positioned on the underside of the slide apparatus 50 and extending between the outer wall 58 and the inner wall 60 of the slide apparatus 50. One or more of the adjustable feet 116 are positioned and configured to engage the slide support bar 68 to support the bottom end 52 of the slide apparatus 50. In some embodiments, the adjustable feet 116 are configured to facilitate selectively adjusting the angle of the stair apparatus 30 and the slide apparatus 50 between zero and twenty degrees relative to the nominal angle of the stair and slide assembly 20 (e.g., to accommodate for uneven ground, to increase the angle of ascent and descent, etc.).

Figure 23:
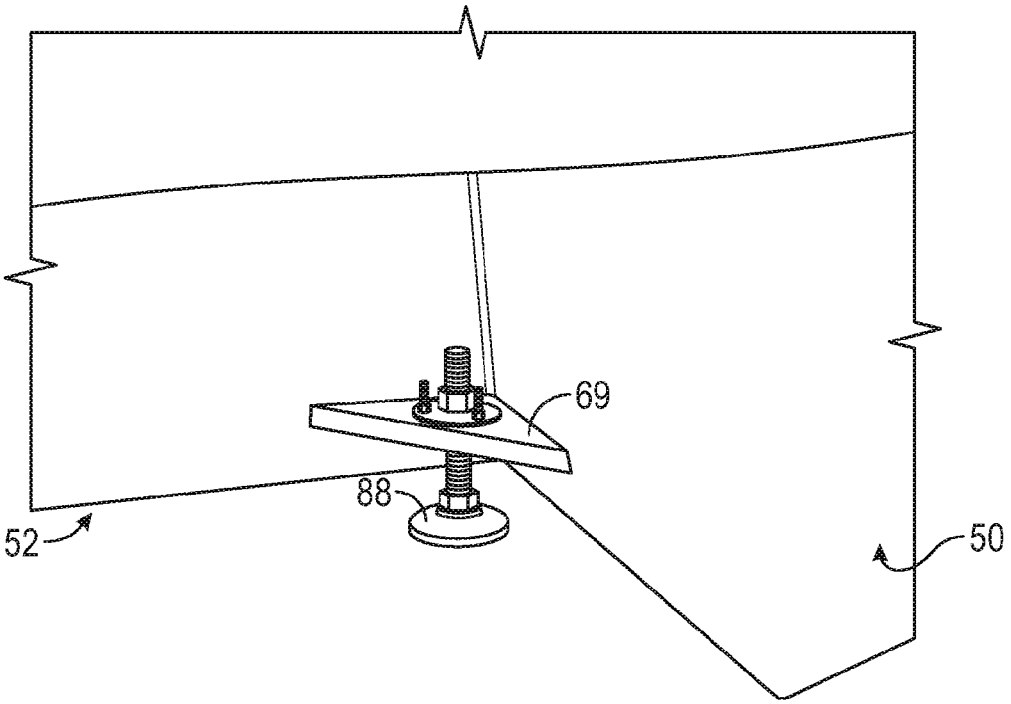
Figure 24:
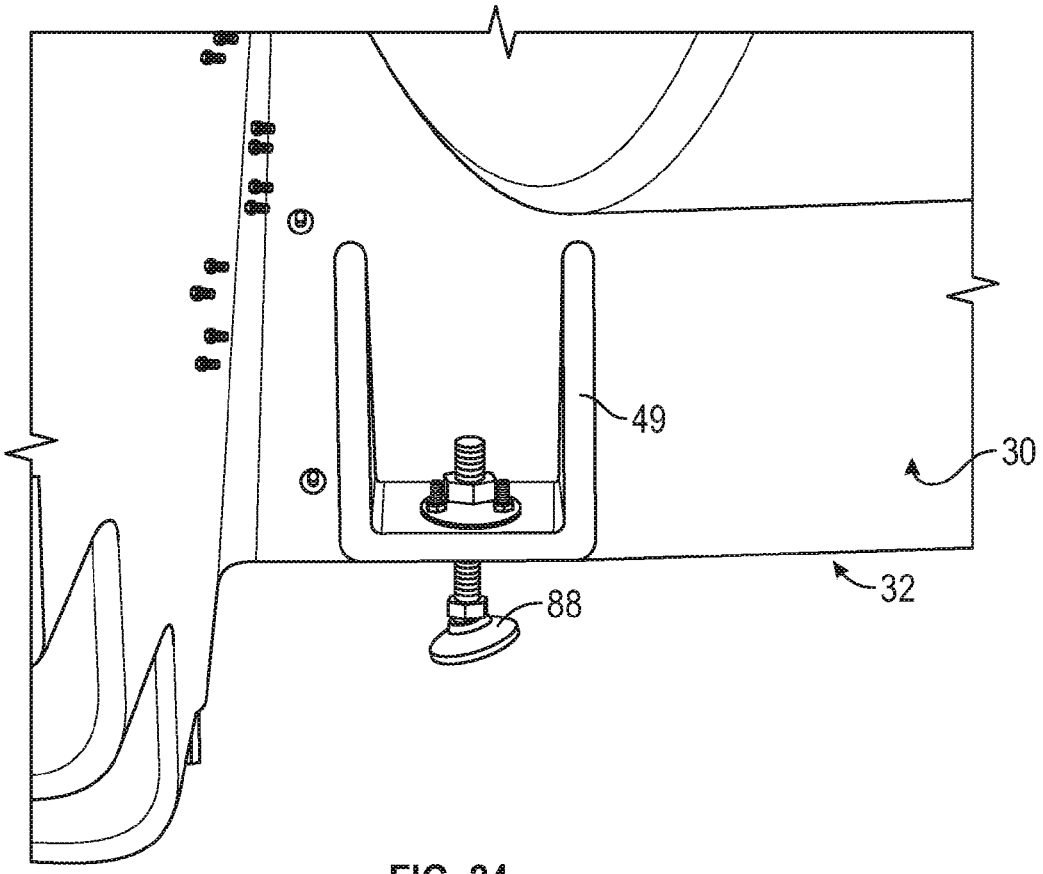

As shown in FIG. 23, the bottom end 52 of the slide apparatus 50 defines an interface, shown as slide leveling interface 69. The slide leveling interface 69 is configured to receive a leveling device, shown as leveling foot 88. As shown in FIG. 24, the bottom end 32 of the stair apparatus 30 defines an interface, shown as stair leveling interface 49. The stair leveling interface 49 is configured to receive a second leveling foot 88. According to an example embodiment, the leveling feet 88 are configured to facilitate accommodating uneven surfaces such that the stair apparatus 30 and the slide apparatus 50 remain level (e.g., substantially horizontal, not crooked, etc.).

As shown in FIGS. 12-15 and 17, the tall frame 120 includes a first frame wall, shown as front frame wall 122; a second frame wall, shown as rear frame wall 132; and a plurality of connectors, shown as connector beams 140, extending between the front frame wall 122 and the rear frame wall 132, coupling the two together. In some embodiments, a first end of the connector beams 140 is releasably secured (e.g., fastened, bolted, etc.) to the front frame wall 122 and/or an opposing second end of the connector beams 140 is releasably secured to the rear frame wall 132. In some embodiments, the first end of the connector beams 140 is fixedly secured (e.g., welded, etc.) to the front frame wall 122 and/or the opposing second end of the connector beams 140 is fixedly secured to the rear frame wall 132.

As shown in FIGS. 12-15 and 17, the front frame wall 122 includes a second plurality of legs (e.g., two, three, four, five, etc.), shown as front tall legs 124. Each of the front tall legs 124 has a base plate, shown as foot plate 128, coupled to a first end (e.g., a lower end, a bottom end, etc.) of each of the front tall legs 124. The foot plates 128 may increase the stability of the front frame wall 122 of the tall frame 120. In some embodiments, the foot plates 128 define a plurality of apertures that are configured to receive fasteners (e.g., bolts, etc.) such that the front frame wall 122 may be secured (e.g., anchored, etc.) to a ground surface. As shown in FIGS. 12-15 and 17, the front frame wall 122 includes a second plurality of connectors, shown as front cross-beams 129, connecting the first ends of the front tall legs 124 to each other and opposing second ends (e.g., upper ends, top ends, etc.) of the front tall legs 124 to each other. In some embodiments, the front tall legs 124 and the front cross-beams 129 are welded together. In some embodiments, the front tall legs 124 and the front cross-beams 129 are fastened together (e.g., with bolts, etc.). As shown in FIGS. 12-15, the front tall legs 124 define a plurality of apertures, shown as apertures 126, positioned between the first ends and the opposing second ends thereof.

As shown in FIGS. 12-15 and 17, the rear frame wall 132 includes a third plurality of legs (e.g., two, three, four, five, etc.), shown as rear tall legs 134. Each of the rear tall legs 134 has a base plate, shown as foot plate 138, coupled to a first end (e.g., a lower end, a bottom end, etc.) of each of the rear tall legs 134. The foot plates 138 may increase the stability of the rear frame wall 132 of the tall frame 120. In some embodiments, the foot plates 138 define a plurality of apertures that are configured to receive fasteners (e.g., bolts, etc.) such that the rear frame wall 132 may be secured (e.g., anchored, etc.) to a ground surface. As shown in FIGS. 12-15 and 17, the rear frame wall 132 includes a third plurality of connectors, shown as rear cross-beams 139, connecting the first ends of the rear tall legs 134 to each other and opposing second ends (e.g., upper ends, top ends, etc.) of the rear tall legs 134 to each other. In some embodiments, the rear tall legs 134 and the rear cross-beams 139 are welded together. In some embodiments, the rear tall legs 134 and the rear cross-beams 139 are fastened together (e.g., with bolts, etc.). As shown in FIGS. 12-15, the rear tall legs 134 define a plurality of apertures, shown as apertures 136, positioned between the first ends and the opposing second ends thereof.

As shown in FIGS. 2 and 3, (i) the front frame wall 122 of the tall frame 120 is positioned to engage with and support the stair apparatus 30, the slide apparatus 50, and the platform 70 of the stair and slide assembly 20, proximate (e.g., near, close to, at, etc.) the top end 34 of the stair apparatus 30, the top end 54 of the slide apparatus 50, and the front end of the platform 70, and (ii) the rear frame wall 132 of the tall frame 120 is positioned to engage with and support the rear end of the platform 70.

Figure 26:
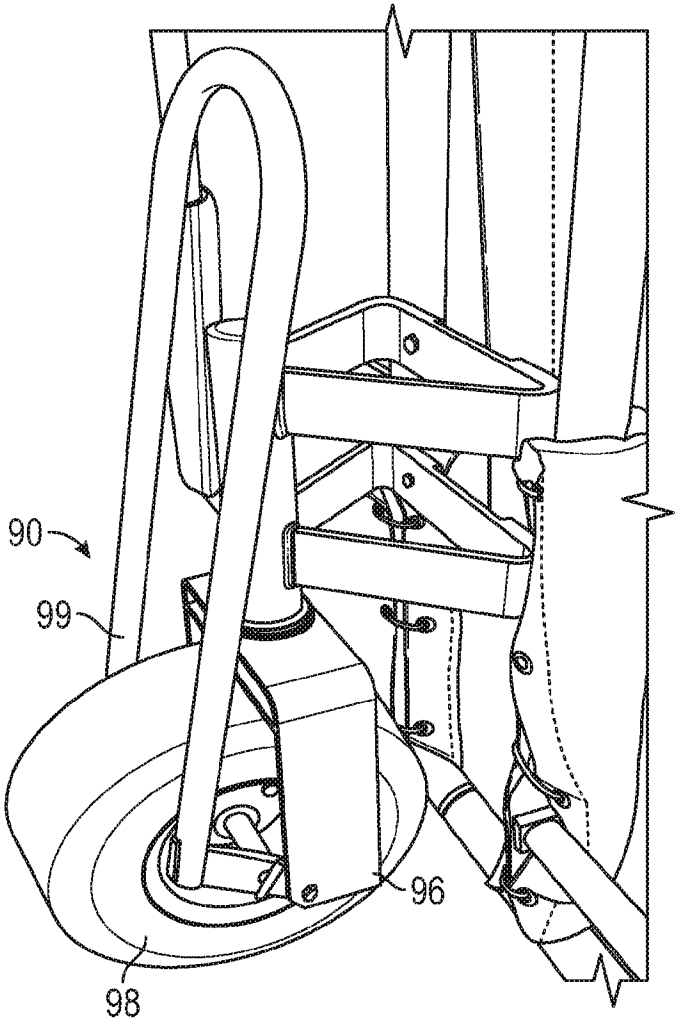
FIGS. 25 and 26 are various views of a wheel assembly of the exercise apparatus of FIG. 1, according to an example embodiment.
Figure 25:
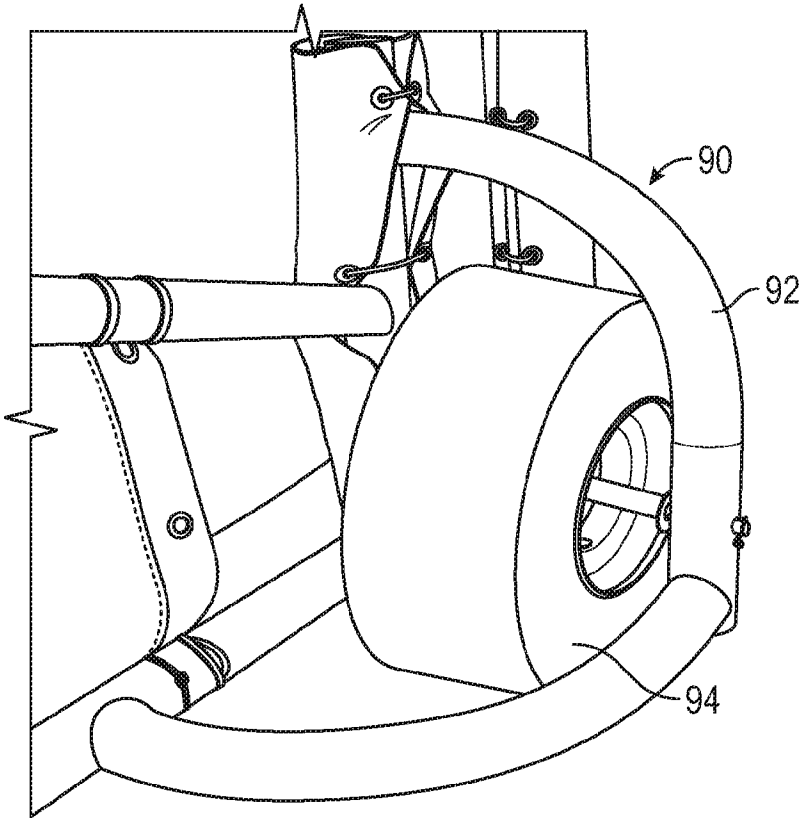

As shown in FIGS. 25 and 26, the exercise apparatus 10 additionally or alternatively includes a wheel assembly, shown as wheel assembly 90, to provide portability and mobility of the exercise apparatus 10. In some embodiments, the wheel assembly 90 is manually operated (e.g., mechanically pushed, pulled, turned, raised, lowered, etc.). In some embodiments, the wheel assembly 90 includes one or more actuators (e.g., hydraulic actuators, pneumatic actuators, electric actuators, etc.) positioned to provide assisted and/or automatic portability and mobility of the exercise apparatus 10 (e.g., assisted or automatic propelling, turning, raising, lowering, etc. of the wheel assembly 90, etc.).

As shown in FIG. 25, the wheel assembly 90 includes a first support, shown as front wheel support 92, configured to support a first wheel, shown as front wheel 94. In one embodiment, the exercise apparatus 10 includes a first front wheel support 92 coupled to the left side of the short frame 110 and a second front wheel support 92 coupled to the right side of the short frame 110 such that the exercise apparatus 10 includes two front wheels 94. In another embodiment, the first front wheel support 92 is alternatively coupled to the outer wall 38 of the stair apparatus 30 at the bottom end 32 thereof and the second front wheel support 92 is alternatively coupled to the outer wall 58 of the slide apparatus 50 at the bottom end 52 thereof.

As shown in FIG. 26, the wheel assembly 90 includes a second support, shown as rear wheel support 96, configured to support a second wheel, shown as rear wheel 98. In one embodiment, the exercise apparatus 10 includes a single rear wheel support 96 coupled to the center of the rear frame wall 132 of the tall frame 120. In another embodiment, the exercise apparatus 10 includes a first rear wheel support 96 coupled to the left side of the rear frame wall 132 and a second rear wheel support 96 coupled to the right side of the rear frame wall 132 such that the exercise apparatus 10 includes two rear wheels 98. In still another embodiment, the exercise apparatus 10 includes a first rear wheel support 96 coupled to the left side of the rear frame wall 132, a second rear wheel support 96 coupled to the right side of the rear frame wall 132, a third rear wheel support 96 coupled to the left side of the front frame wall 122, and fourth rear wheel support 96 coupled to the right side of the front frame wall 122 such that the exercise apparatus 10 includes four rear wheels 98. As shown in FIG. 26, the rear wheel support 96 includes a steering mechanism, shown as steering mechanism 99 that facilitates steering the rear wheels 98. The steering mechanism 99 may be manually operated or actuator operated.

According to the example embodiment shown in FIGS. 2, 3, and 12-16, the short frame 110, the tall frame 120, and the connector beams 150 form a single, interconnected frame assembly 100 that cooperatively supports the entire stair and slide assembly 20 (e.g., the stair apparatus 30, the slide apparatus 50, the platform 70, etc.). In other embodiments, the stair apparatus 30, the slide apparatus 50, and/or the platform 70 are supported by an individual frame subassembly to provide increased modularity for the exercise apparatus 10. The individual frame subassemblies may be releasably joined together to form the frame assembly 100 (e.g., fastened, bolted, clamped, interlocked, etc.). By way of example, the stair apparatus may be supported by a first frame subassembly, the slide apparatus 50 may be supported by a second frame subassembly, and the platform 70 may be supported by a third frame subassembly. By way of another example, the stair apparatus 30 and the slide apparatus 50 may be supported by a first frame subassembly and the platform 70 may be supported by a second frame subassembly. By way of yet another example, the stair apparatus 30 and the stair portion 76 of the platform 70 may be supported by a first frame subassembly and the slide apparatus 50 and the slide portion 78 of the platform 70 may be supported by a second frame subassembly. By way of still another example, the stair apparatus 30 may be supported by a first frame subassembly, the slide apparatus 50 may be supported by a second frame subassembly, the stair portion 76 of the platform 70 may be supported by a third frame subassembly, and the slide portion 78 of the platform 70 may be supported by a fourth frame subassembly.

According to an example embodiment, providing a modular exercise apparatus 10 facilitates designing each exercise apparatus to a specific user's needs. By way of example, one user may only desire a single stair apparatus 30 and a single slide apparatus 50. By way of another example, another user may desire a single stair apparatus 30 with dual slide apparatuses 50, one positioned on each side of the single stair apparatus 30. By way of yet another example, still another user may desire to abut two exercise apparatuses 10 side by side to create a zig-zag path through the exercise apparatus (e.g., up a first stair apparatus 30, down a first slide apparatus 50, up a second stair apparatus 30, and down as second slide apparatus 50, etc.). Therefore, a user may acquire any number of stair apparatuses 30, slide apparatuses 50, and/or platforms 70 and arrange them in any desired configuration.

In some embodiments, a first exercise apparatus 10 and a second exercise apparatus 10 are positioned parallel with each other and spaced apart such that a gap is formed there between. The first exercise apparatus 10 and the second exercise apparatus 10 may be joined by an intermediate frame rig that includes various exercise equipment and devices, as described in more detail herein. In some embodiments, an intermediate platform is positioned to connect the two exercise apparatuses 10. In some embodiments, three exercise apparatuses are positioned in a T-shape and connected together with intermediate frame rigs and/or platforms. In some embodiments, four exercise apparatuses 10 are positioned in a cross-shape and connected together with intermediate frame rigs and/or platforms.

As shown in FIGS. 12-19, the frame assembly 100 supports various exercise devices, exercise equipment, and storage devices. More specifically, the various exercise devices, exercise equipment, and storage devices may include, but are not limited to, side bars 152, straight dip handles 154, angled dip handles 156, storage racks 158, a step platform assembly 160, a throw wall assembly 170, a speed bag assembly 180, a punching bag assembly 190, a suspension band bar 200, a dip assembly 210, a pull-up assembly 220, one or more storage shelves 230, one or more storage racks 232, one or more pull-up bars 234, a trapeze bar assembly 240, plate horns (e.g., to hold unused weight plates, etc.), and/or still other exercise devices, exercise equipment, and storage devices. According to an example embodiment, one or more of the side bars 152, the straight dip handles 154, the angled dip handles 156, the storage racks 158, the step platform assembly 160, the throw wall assembly 170, the speed bag assembly 180, the punching bag assembly 190, the suspension band bar 200, the dip assembly 210, the pull-up assembly 220, the one or more storage shelves 230, the one or more storage racks 232, the trapeze bar assembly 240, the plate horns, etc. are removable from the frame assembly 100 (e.g., releasably coupled thereto, etc.).

In some embodiments, the frame assembly 100 additionally or alternatively includes free weight lifting rigs (e.g., bench presses, squat racks, etc.) configured to facilitate bench pressing, squatting, etc. . . . . The free weight lifting rigs may include benches, adjustable pegs, bar holders, arms, supports, etc. In some embodiments, the frame assembly 100 additionally or alternatively includes hooks variously positioned about the frame assembly (e.g., high up, low, mid-range, etc.) to facilitate attaching elastic bands and/or ropes to the frame assembly 100 such that users may perform various exercises with elastic bands and/or ropes.

As shown in FIGS. 12-15 and 20, the side bars 152 include U-shaped bars having a plurality of spaced pegs or hooks. The side bars 152 are coupled to (e.g., releasably fastened, welded, etc.) and extend from each of the connector beams 150. The plurality of spaced pegs or hooks may facilitate securing elastic bands to the side bars 152 to perform various elastic band exercises. The side bars 152 may additionally or alternatively be configured to hold medicine balls, dumbbells, and/or still other free weight exercise equipment. Alternatively, the side bars 152 may be used for incline pushups, dips, and/or other body exercises. As shown in FIG. 16, the connector beams 150 do not include the side bars 152. Rather, the connector beams 150 includes the straight dip handles 154, the angled dip handles 156, and the storage racks 158 (e.g. configured to hold free weights, medicine balls, exercise balls, etc.).

As shown in FIGS. 12-15, the step platform assembly 160 includes a support, shown as leg 162 that extends from the ground surface to one of the connector beams 140. The leg 162 defines a plurality of apertures, shown as apertures 164, along a portion of the length thereof. The leg 162 has a base plate, shown as foot plate 166, coupled to an end (e.g., a lower end, a bottom end, etc.) of the leg 162. The foot plate 166 may increase the stability of the step platform assembly 160. The step platform assembly 160 further includes a platform, shown as step platform 168, coupled to the leg 162. According to an example embodiment, the apertures 164 facilitate selectively changing the height of the step platform 168 along the leg 162 (e.g., sliding the step platform 168 up or down, etc.). In other embodiments, the step platform 168 is coupled to one of the front tall legs 124 or the rear tall legs 134 of the tall frame 120.

Figure 14:
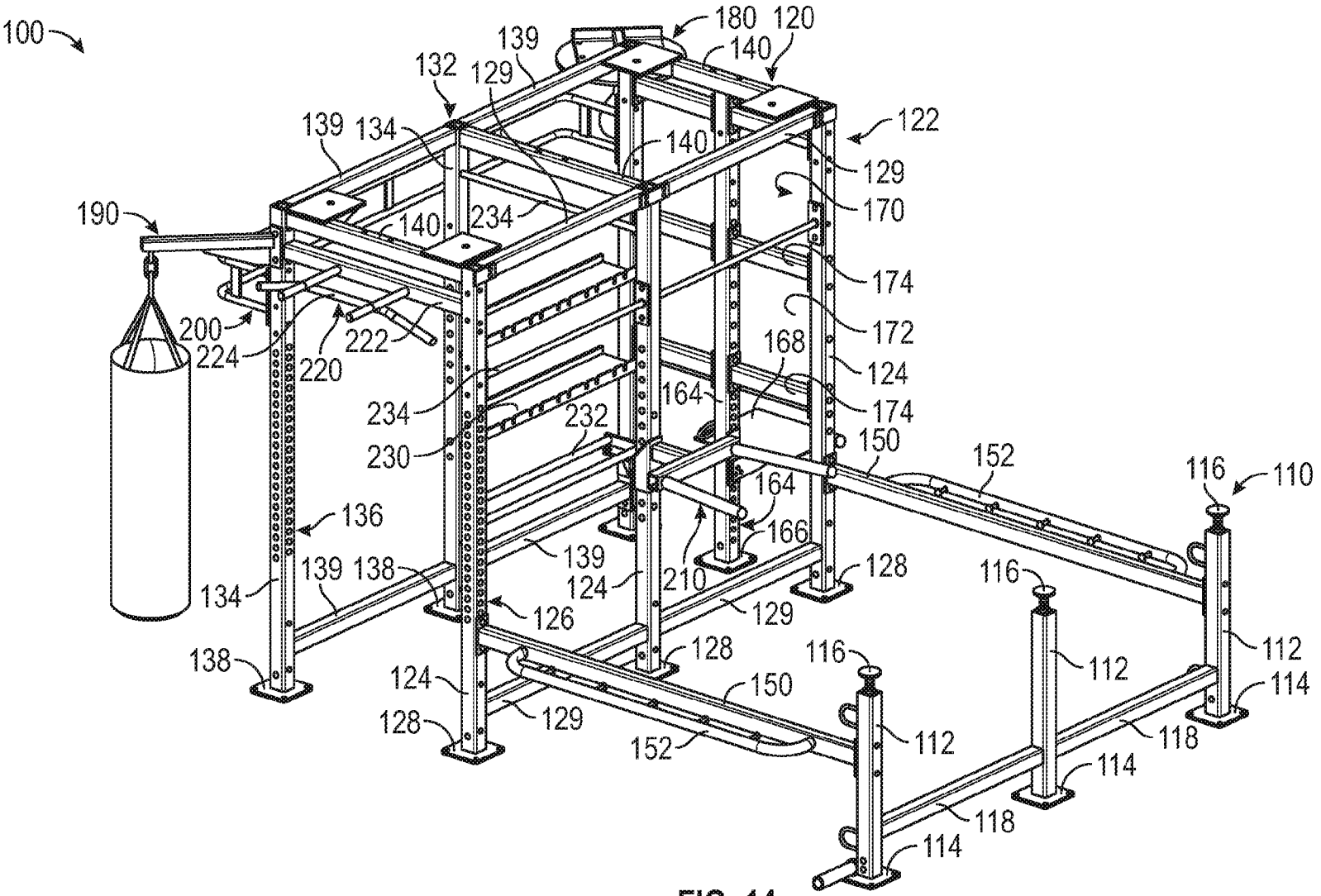
Figure 15:
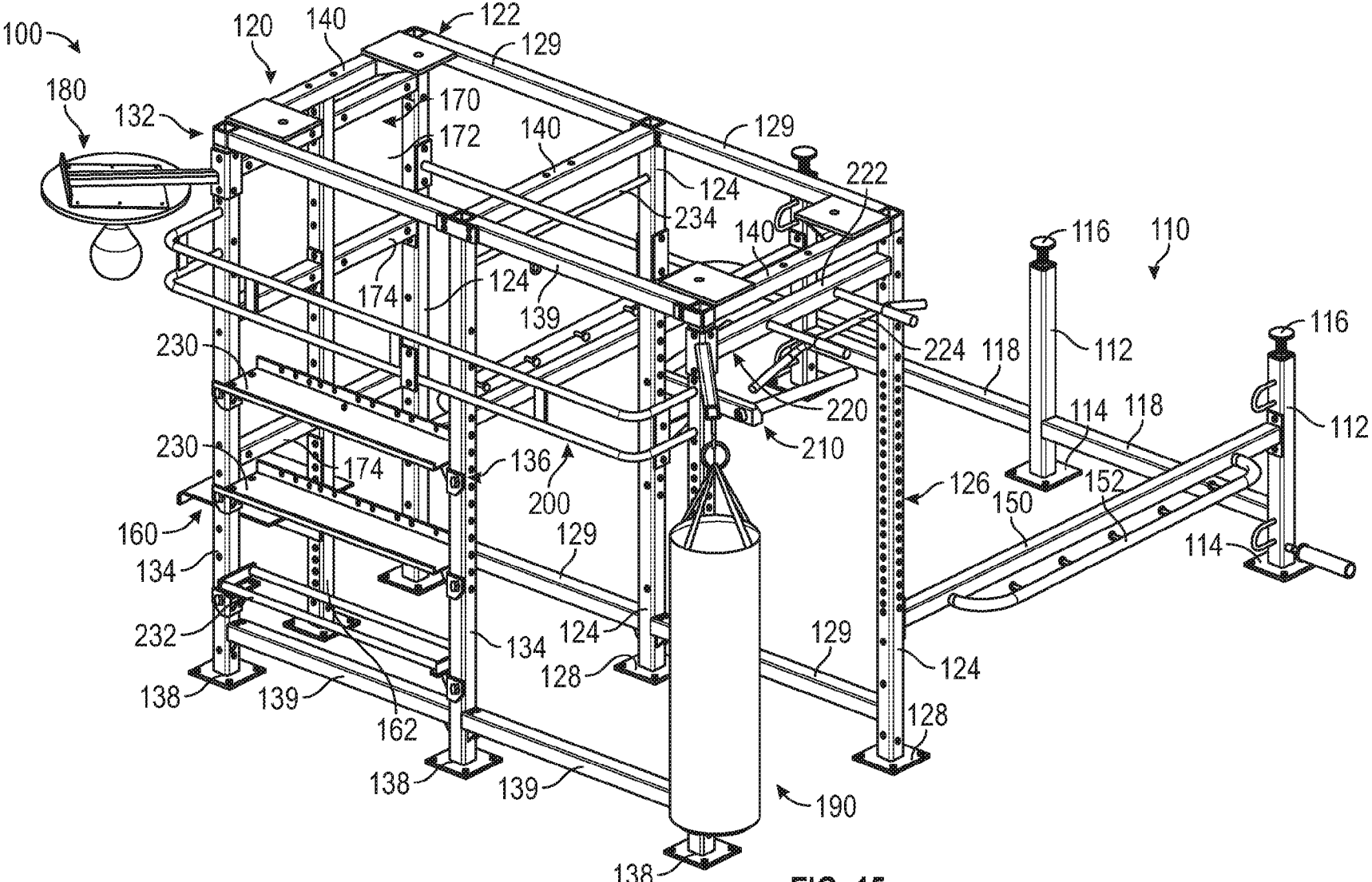
Figure 16:
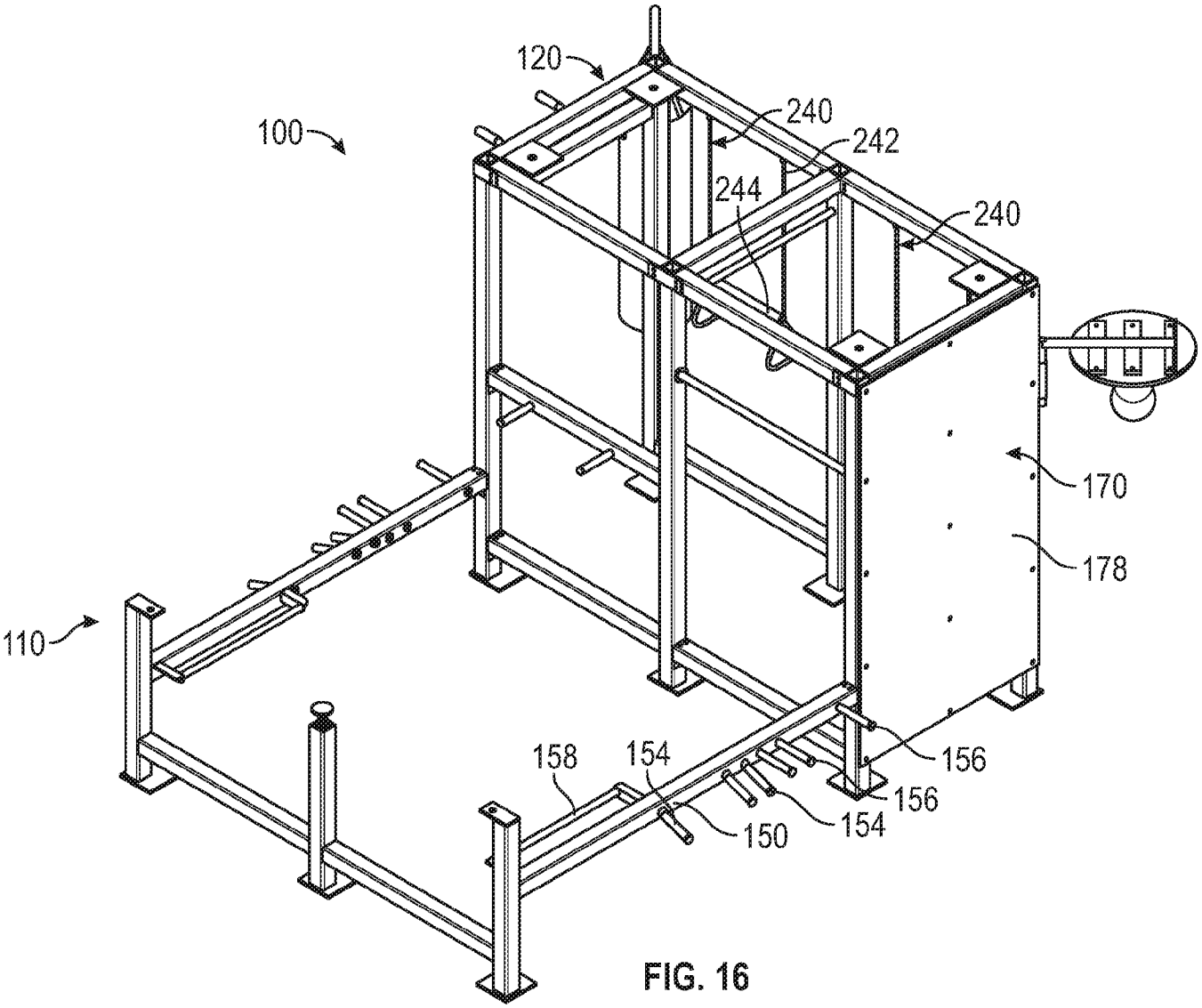
Figure 17:
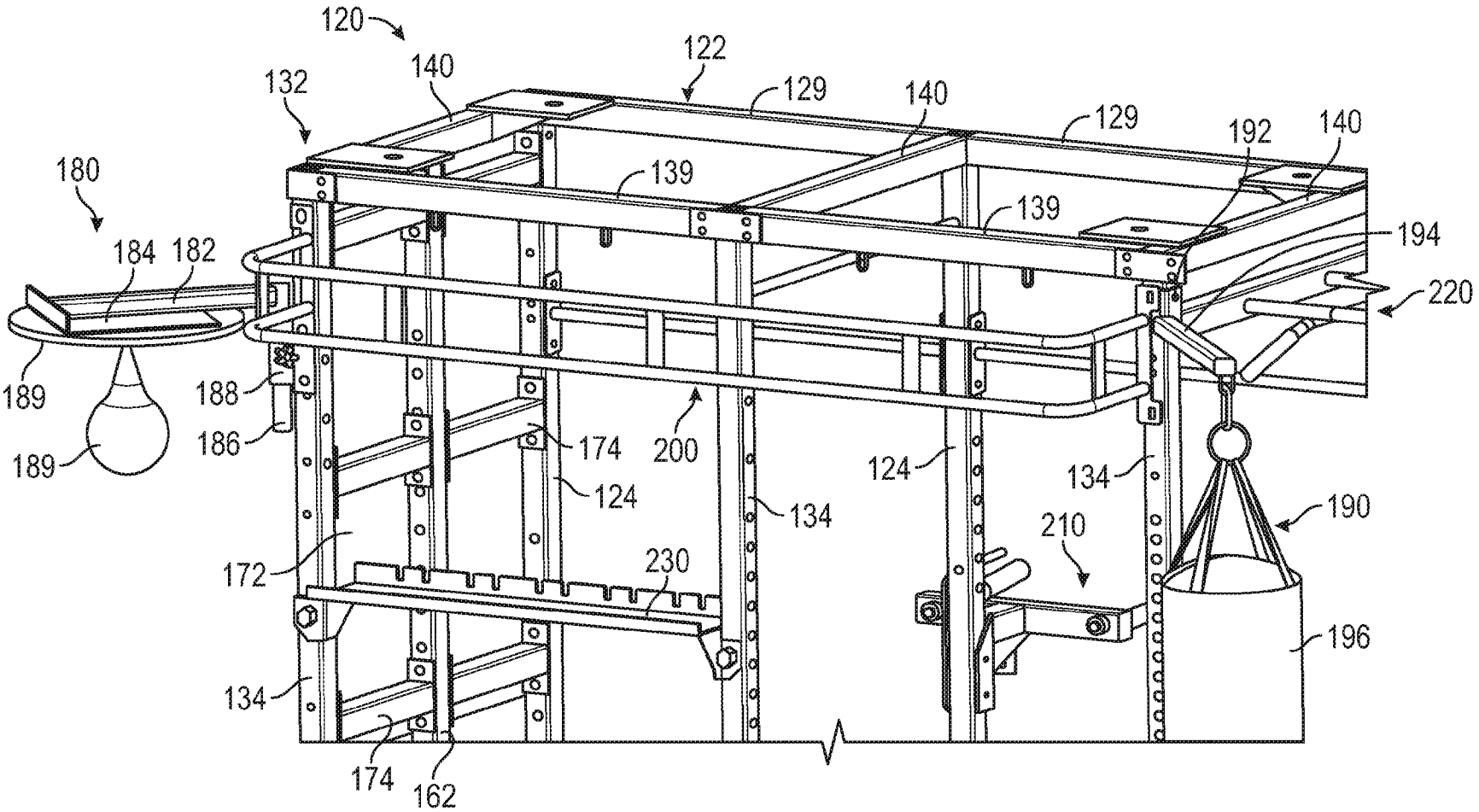

As shown in FIGS. 12-15 and 17, the throw wall assembly 170 includes a wall, shown as throw wall 172, extending between one of the front tall legs 124 and one of the rear tall legs 134. As shown in FIGS. 12-15, the throw wall 172 extends partially from the top to the bottom of the tall frame 120. As shown in FIG. 16, the throw wall 172 is replaced with a second throw wall, shown as throw wall 178 that extends the entire length from the top to the bottom of the tall frame 120. As shown in FIGS. 14, 15, and 17, the throw wall assembly 170 includes a plurality of supports, shown as support beams 174 that extend between the leg 162, one of the front tall legs 124, and one of the rear tall legs 134. The support beams 174 may reinforce the throw wall 172 (or throw wall 178) from impacts experienced thereby (e.g., from a user throwing a medicine ball against the throw wall 172, etc.). In some embodiments, the throw wall assembly 170 is otherwise positioned (e.g., extends between adjacent front tall legs 124, extends between adjacent rear tall legs 134, etc.).

Figure 18:
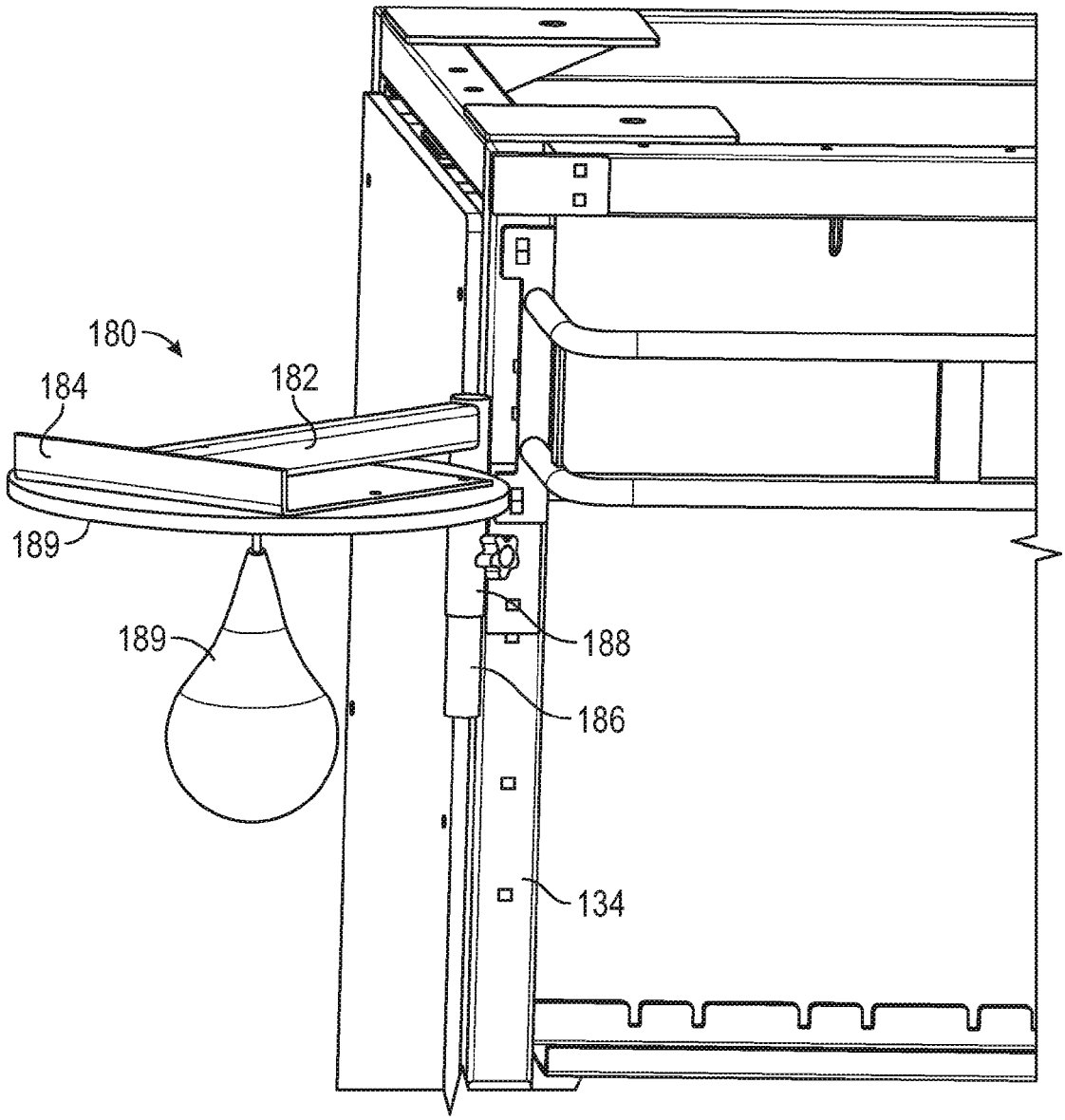
Figure 19:
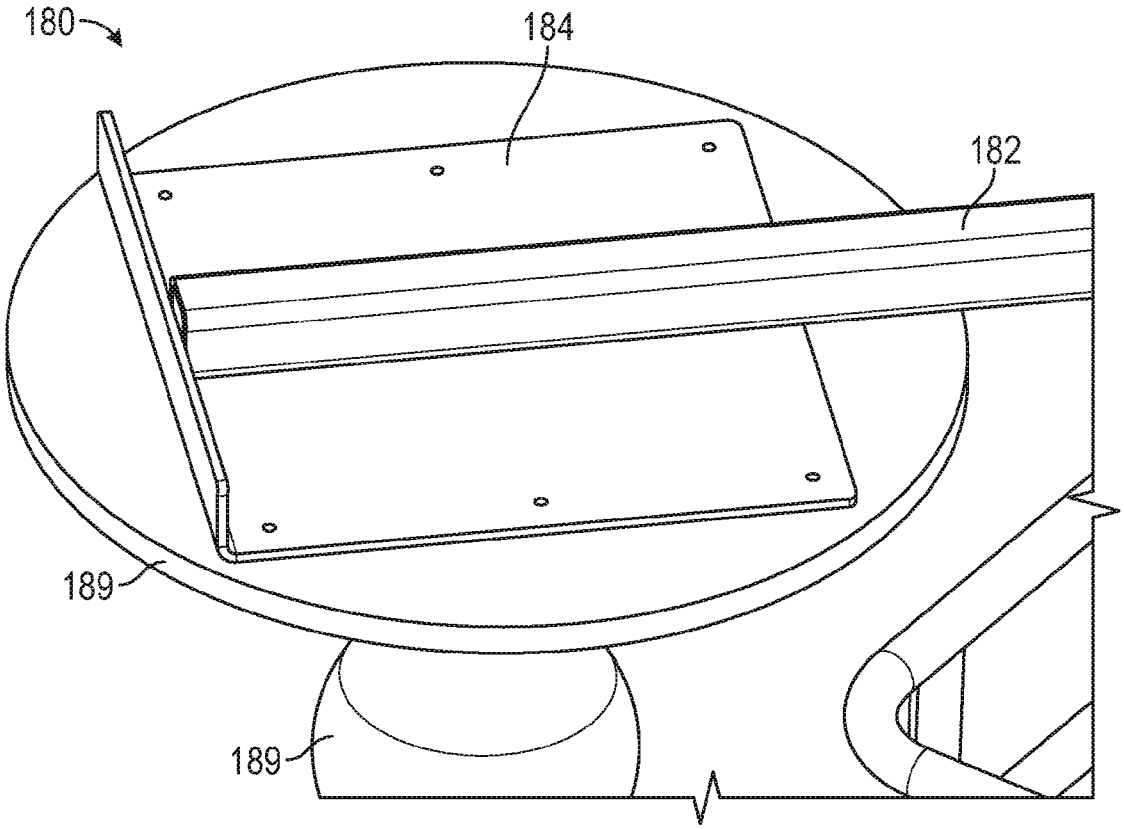
Figure 20:
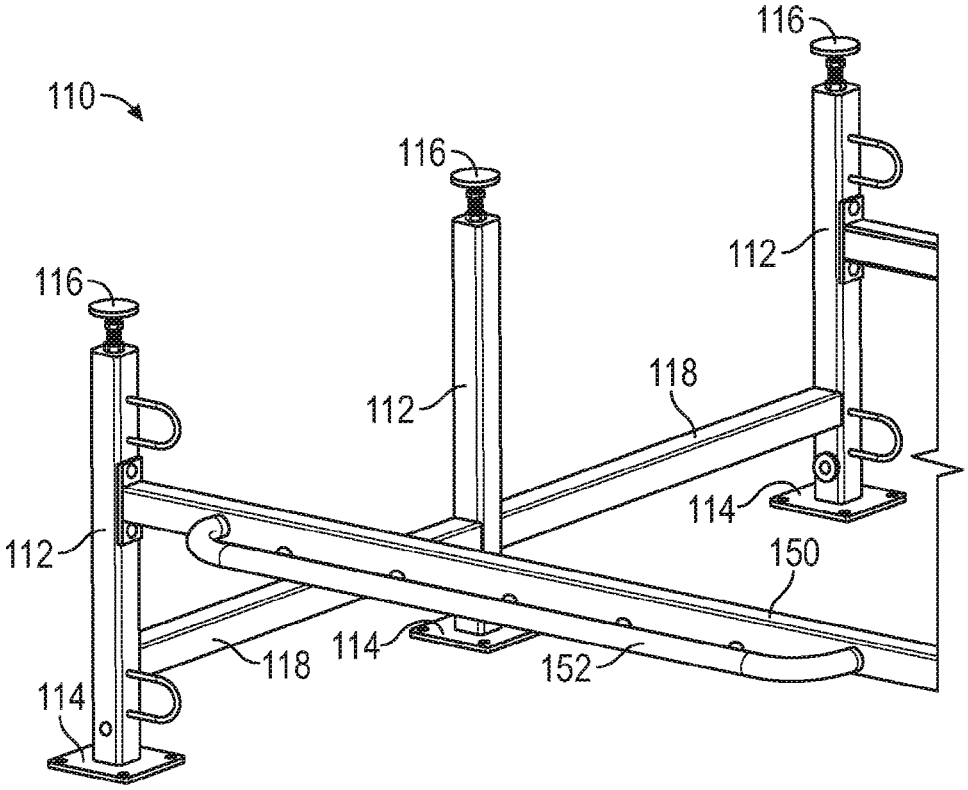

As shown in FIGS. 12-15, 17, and 18, the speed bag assembly 180 extends from one of the rear tall legs 134. In other embodiments, the speed bag assembly 180 extends from one of the front tall legs 124. As shown in FIGS. 17-19, the speed bag assembly 180 includes an extender, shows as extension beam 182; a plate, shown as support plate 184, coupled to a far end (e.g., a distal end, etc.) of the extension beam 182; a tubular member, shown as tube 186, extending perpendicularly from the extension beam 182; a bracket, shown as bracket 188, coupled to the tall frame 120 (e.g., one of the rear tall legs 134, etc.) that slidably receives the tube 186 to facilitate adjusting the height of the speed bag assembly 180; and a speed bag, shown as speed bag 189, coupled to the support plate 184.

As shown in FIGS. 12-15 and 17, the punching bag assembly 190 extends from one of the rear tall legs 134. In other embodiments, the punching bag assembly 190 extends from one of the front tall legs 124. As shown in FIG. 17, the punching bag assembly 190 includes a bracket, shown as bracket 192, that is configured to couple to the tall frame 120; an extender, shows as extension beam 194, extending from the bracket 192; and a weighted bag, shown as punching bag 196, coupled to a far end (e.g., a distal end, etc.) of the extension beam 194.

As shown in FIGS. 12-15 and 17, the suspension band bar 200 has a U-shape and extends from the rear frame wall 132. The suspension band bar 200 may be used in various exercises involving elastic workout bands, pull-ups, etc. The suspension band bar 200 may be otherwise positioned, removed, and/or replaced with other exercise equipment/components. As shown in FIGS. 13-15 and 17, the dip assembly 210 is coupled to one of the front tall legs 124. In other embodiments, the dip assembly 210 is coupled to one of the rear tall legs 134.

According to an example embodiment, the apertures 126 (or the apertures 136) facilitate selectively changing the height of the dip assembly 210 along the front tall leg 124 (or the rear tall leg 134).

As shown in FIGS. 14 and 15, the pull-up assembly 220 includes a support, shown as support bar 222, extending between one of the front tall legs 124 and one of the rear tall legs 134, and a bar, shown as pull-up bar 224, extending from the support bar 222. In some embodiments, the support bar 222 is otherwise positioned (e.g., extends between adjacent front tall legs 124, extends between adjacent rear tall legs 134, etc.). As shown in FIGS. 12, 14, 15, and 17, the storage shelves 230 and the storage racks 232 extend between adjacent rear tall legs 134 and interface with the apertures 136 thereof. In other embodiments, the storage shelves 230 and/or the storage racks 232 extend between adjacent front tall legs 124 and interface with the apertures 126 thereof. The storage shelves 230 and/or the storage racks 232 may receive and hold kettle balls, medicine balls, exercise balls, dumbbells, and/or other exercise equipment. The storage shelves 230 and/or the storage racks 232 may be removable, relocatable, and/or height adjustable.

As shown in FIGS. 12-15, the pull-up bars 234 are variously positioned about the tall frame 120. For example, the pull-up bars 234 may extend between adjacent front tall legs 124, between adjacent rear tall legs 134, and/or between a respective front tall leg 124 and a respective rear tall leg 134. The pull-up bars 234 may be removable, relocatable, height adjustable, and/or provide additional support to the frame assembly 100. As shown in FIG. 16, the trapeze bar assembly 240 includes suspension members, shown as suspension cables 242, extending from the tall frame 120, and a bar, shown as trapeze bar 244, coupled to the suspension cables 242. According to an example embodiment, the frame assembly 100 is highly modular and customizable (e.g., because of the apertures 126, the apertures 136, etc.). It should therefore be understood that any of the various components coupled to the frame assembly 100 may be otherwise positioned, adjusted, removed, and/or replaced with other exercise components/devices.

In some embodiments, the exercise apparatus 10 additionally or alternatively includes kid friendly playground apparatuses and/or devices underneath the stair and slide assembly 20. By way of example, the exercise apparatus 10 may include swings, a sandbox, monkey bars, a rock wall, and/or still other playground apparatuses for children to play on and/or with.

Figure 27:
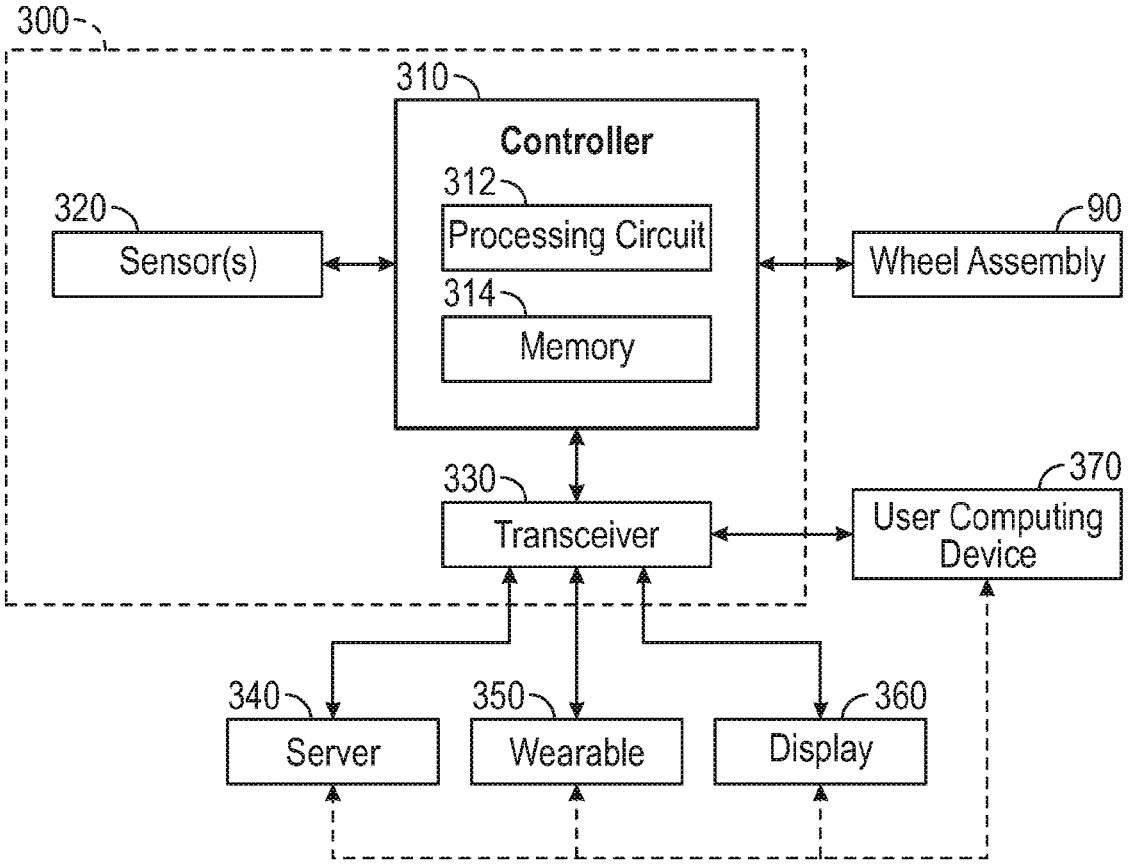
FIG. 27 is a schematic diagram of an exercise tracking system, according to an example embodiment.

According to the example embodiment shown in FIG. 27, the exercise tracking system 300 includes a controller 310. In one embodiment, the controller 310 is configured to selectively engage, selectively disengage, control, and/or otherwise communicate with components of the exercise apparatus 10. As shown in FIG. 27, the controller 310 is coupled to the wheel assembly 90, one or more sensors 320, a transceiver 330, a server 340, a wearable device 350 (e.g., a smartwatch, a Fitbit, an Apple Watch, an Android watch, a heart rate monitor, etc.), a display 360 (e.g., a television, a monitor, a touch screen, etc.), and a user computing device 370 (e.g., a smartphone, a tablet, a laptop, a computer, etc.). In other embodiments, the controller 310 is coupled to more or fewer components. By way of example, the controller 310 may send and/or receive signals with the wheel assembly 90, the sensors 320, the transceiver 330, the server 340, the wearable device 350, the display 360, and/or the user computing device 370.

The controller 310 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the example embodiment shown in FIG. 27, the controller 310 includes a processing circuit 312 and a memory 314. The processing circuit 312 may include an ASIC, one or more FPGAs, a DSP, circuits containing one or more processing components, circuitry for supporting a microprocessor, a group of processing components, or other suitable electronic processing components. In some embodiments, the processing circuit 312 is configured to execute computer code stored in the memory 314 to facilitate the activities described herein. The memory 314 may be any volatile or non-volatile computer-readable storage medium capable of storing data or computer code relating to the activities described herein. According to an example embodiment, the memory 314 includes computer code modules (e.g., executable code, object code, source code, script code, machine code, etc.) configured for execution by the processing circuit 312. In some embodiments, controller 310 represents a collection of processing devices (e.g., servers, data centers, etc.). In such cases, the processing circuit 312 represents the collective processors of the devices, and the memory 314 represents the collective storage devices of the devices.

According to an example embodiment, the controller 310 is configured to facilitate operating the wheel assembly 90. By way of example, the controller 310 may be configured to transmit command signals to the one or more actuators (e.g., hydraulic actuators, pneumatic actuators, electric actuators, etc.) positioned to provide assisted and/or automatic portability and mobility of the exercise apparatus 10 (e.g., assisted or automatic propelling, turning, raising, lowering, etc. of the wheel assembly 90, etc.). In some embodiments, a user may control the actuation of the one or more actuators via a user input device (e.g., a joystick, a touchscreen, one or more buttons or switches, etc.).

According to an example embodiment, the controller 310 is configured to receive first user exercise data from the sensor(s) 320 and/or second user exercise data from the wearable device(s) 350. By way of example, the sensors 320 may include various sensors positioned about the stair and slide assembly 20 and/or the frame assembly 100 to track the movement of one or more users to acquire the first user exercise data. For example, the exercise apparatus 10 may include a sensor positioned at the bottom end 32 of the stair apparatus 30, the top end 34 of the stair apparatus 30, the top end 54 of the slide apparatus 50, the bottom end 52 of the slide apparatus 50, and/or at any location about the frame assembly 100. Such sensors 320 may be configured to facilitate tracking the first user exercise data indicative of, but not limited to, the total number of laps, the time to ascend the steps 36 on each lap, the time to descend the slide 56 on each lap, the total time for each lap, the elapsed time of the current workout, the number of reps/sets a user has performed using the exercise equipment (e.g., the side bars 152, the straight dip handles 154, the angled dip handles 156, the step platform assembly 160, the throw wall assembly 170, the speed bag assembly 180, the punching bag assembly 190, the suspension band bar 200, the dip assembly 210, the pull-up assembly 220, the one or more pull-up bars 234, the trapeze bar assembly 240, the bench press, the squat rack, etc.), etc. for each user of the exercise apparatus 10. The wearable device 350 may include sensors that are capable of tracking the second user exercise data indicative of, but not limited to, a respective user's heart rate, blood pressure, breathing patterns, number of steps, stride length, elapsed time of the current workout, etc.

According to an example embodiment, the controller 310 is configured to communicate the user exercise data received from the sensors 320 and/or the wearable device 350 to the server 340, the wearable device 350, the display 360, and/or the user computing device 370 via the transceiver 330 using any suitable wired and/or wireless communication protocol (e.g., Bluetooth, radio, cellular, Wi-Fi, ZigBee, near-field communication, etc.). By way of example, the controller 310 may upload the user exercise data to the server 340 such that the data may be accessed by a respective user via his or her own personal user computing device 370 over the Internet or an Intranet (e.g., a private network, etc.). In some embodiments, the server 340 may push the user exercise data to the wearable device 350, the display 360, and/or the user computing device 370. By way of another example, the controller 310 may send the data directly to the wearable device 350, the display 360, and/or the user computing device 370. The display 360 may be attached to the exercise apparatus 10 and/or remotely positioned relative to the exercise apparatus 10.

In some embodiments, the controller 310 is configured to track where a user is on the exercise apparatus 10 and what the user is doing (e.g., via the sensors 320, etc.) to identify patterns and/or current performance of the user. The controller 310 may be further configured to provide an indication to the user (e.g., via the wearable device 350, via the display 360, via a speaker system, an audible indication, a visual indication, a haptic indication, etc.) based on the first user exercise data and/or the second user exercise data such that the user may adjust his or her current patterns and/or performance. By way of example, the controller 310 may direct the user via the display 360, directly on their wearable device 350, via a speaker system, etc. to perform a different workout, speed up, slow down, take a break, hydrate, etc. to achieve user defined goals and/or keep the user at an appropriate level of intensity/difficulty.

Figure 28:
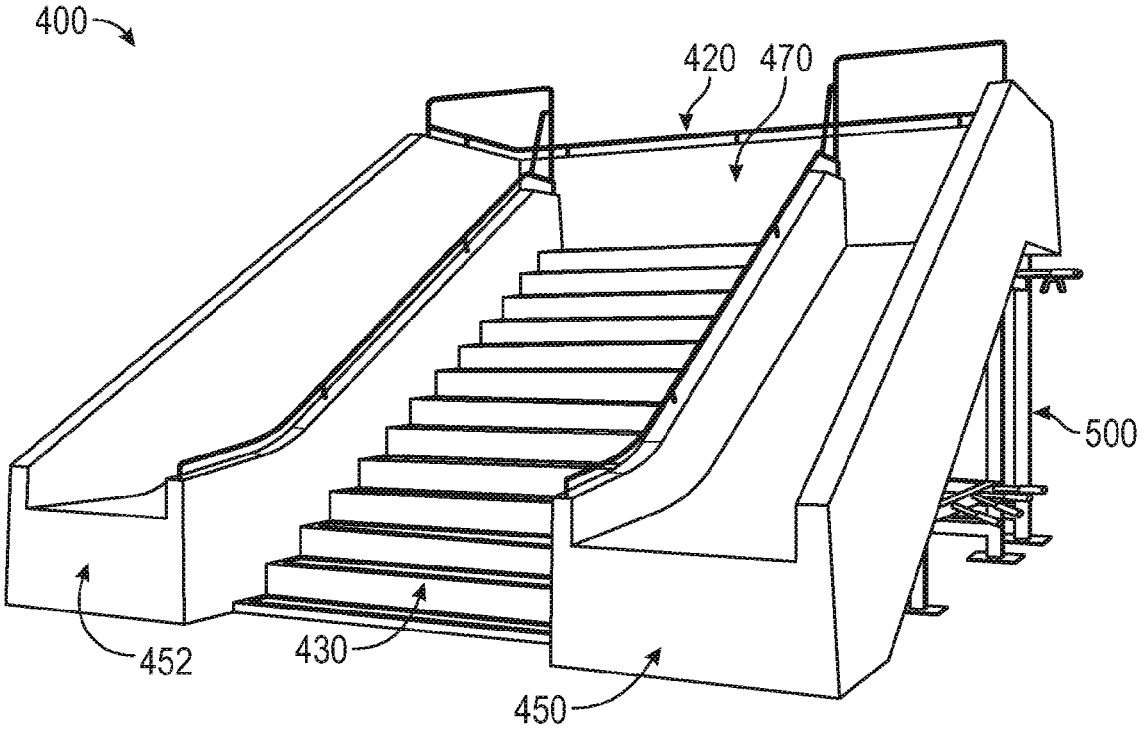
FIGS. 28-30 are various views of an exercise apparatus, according to another example embodiment.
Figure 29:
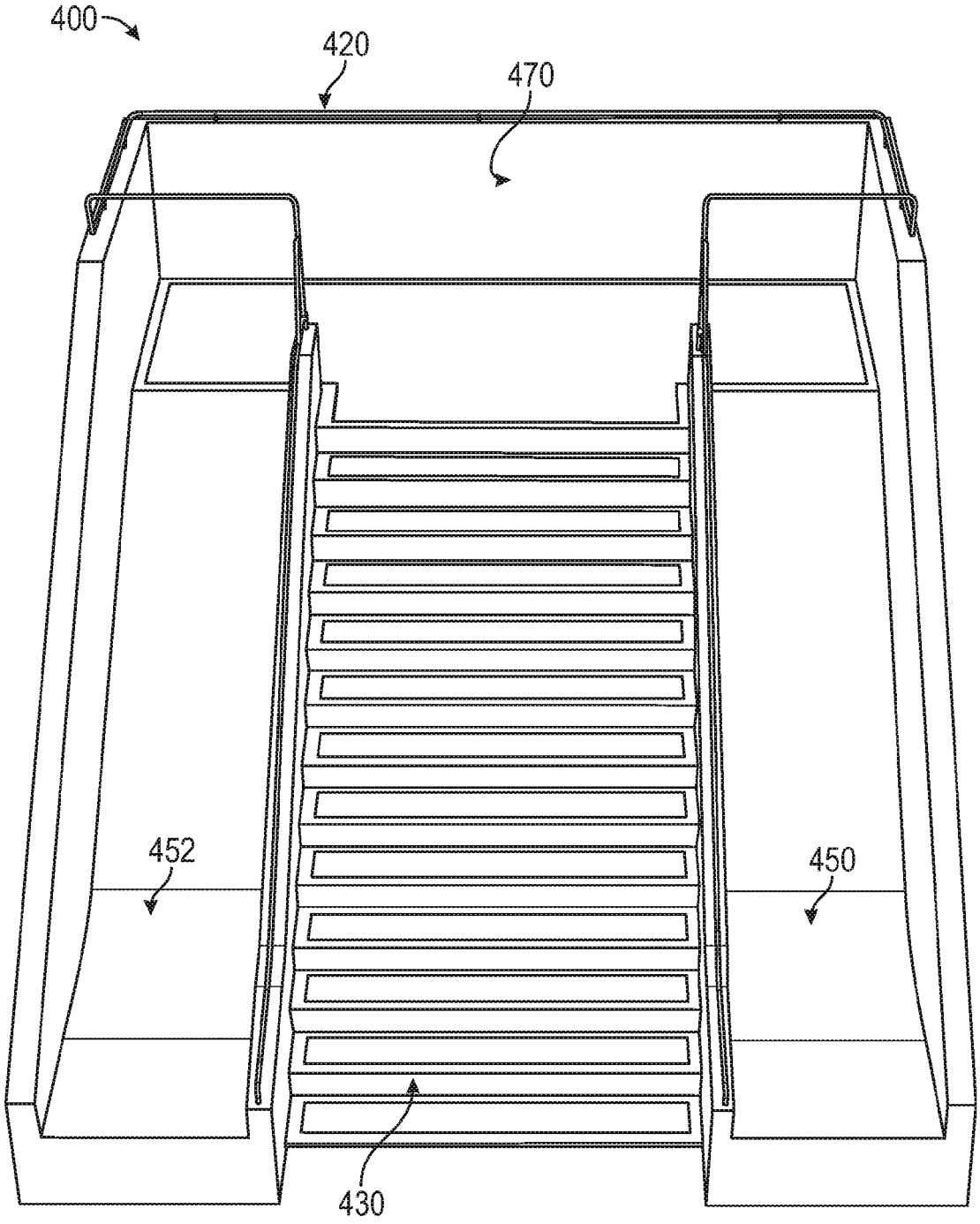
Figure 30:
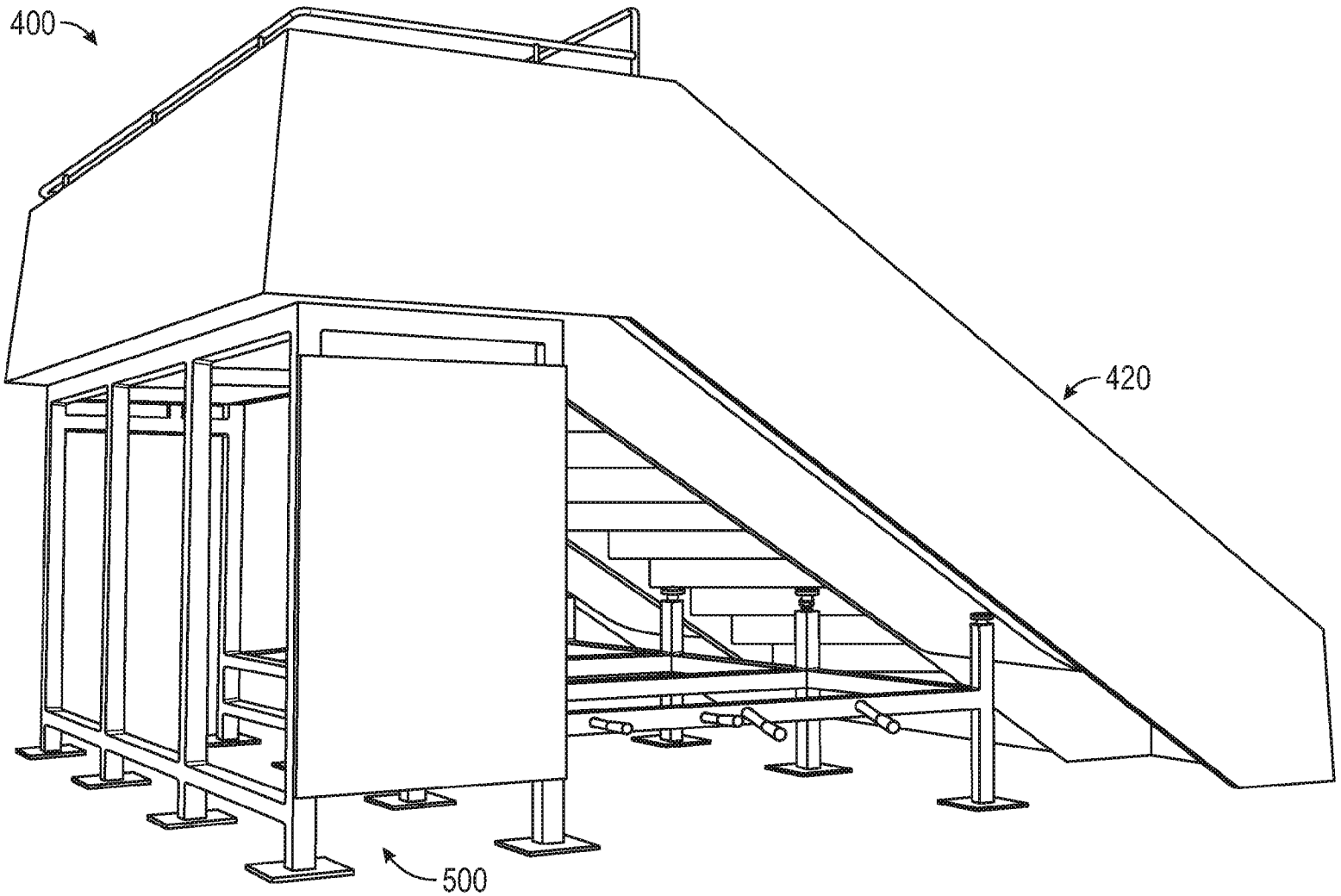

According to the example embodiment shown in FIGS. 28-30, a second multipurpose training exercise apparatus, shown as exercise apparatus 400, includes a double stair and slide assembly, shown as stair and slide assembly 420, supported by a double frame assembly, shown as frame assembly 500. As shown in FIGS. 28 and 29, the stair and slide assembly 420 includes a first portion, shown as stair apparatus 430; a second portion, shown as first slide apparatus 450, positioned on a first side of the stair apparatus 430; a third portion, shown as second slide apparatus 452, positioned on an opposing second side of the stair apparatus 430; and a fourth portion, shown as platform 470, the extends along the width of the stair and slide assembly 420 across the first slide apparatus 450, the stair apparatus 430, and the second slide apparatus 452. The stair apparatus 430, the first slide apparatus 450, the second slide apparatus 452, the platform 470, and/or the frame assembly 500 may be substantially similar to the stair apparatus 30, the slide apparatus 50, the platform 70, and/or the frame assembly 100, respectively, of FIGS. 1-26 and FIGS. 31-37. It should be understood that any of the disclosure pertaining to the exercise apparatus 10 herein may also apply to the exercise apparatus 400.

According to an example embodiment, the stair apparatus 430 is about one and a half to three times wider than the stair apparatus 30. In some embodiments, the steps of the stair apparatus 430 are spaced in a single-stride step arrangement. In some embodiments, the steps of the stair apparatus 430 are spaced in a double-stride step arrangement. In some embodiments, a first half (e.g., a left half, a right half, etc.) of the steps of the stair apparatus 430 are spaced in a single-stride step arrangement and a second half (e.g., a right half, a left half, etc.) of the steps of the stair apparatus 430 are spaced in a double-stride step arrangement. In some embodiments, the steps of the stair apparatus 430 are reconfigurable between a single-stride step arrangement and a double-stride step arrangement (e.g., individual steps may be capable of being selectively dropped, raised, lowered, etc. such that stride lengths can be selectively set by the user).

FIGS. 31-37 illustrate an example of an exercise apparatus 1000, which may the same as or similar to the exercise apparatus 10, 400, consistent with implementations of the current subject matter. In other words, the exercise apparatus 1000 may include one or more of the same features, components, and/or properties as the features, components, and/or properties of the exercise apparatus 10, 400, and the one or more features, components, and/or properties of the exercise apparatus 1000 may be replaced with one or more features, components, and/or properties of the exercise apparatus 10, 400 (or vice versa) as described herein. Additionally and/or alternatively, one or more features, components, and/or properties of the exercise apparatus 10, 400 described herein may be implemented in the exercise apparatus 1000 and/or one or more features, components, and/or properties of the exercise apparatus 1000 described herein may be implemented in the exercise apparatus 10, 400. For example, as shown in FIGS. 31-37, the exercise apparatus 1000 may include a stair and slide assembly 1020 (including a stair apparatus 1030, a slide apparatus 1050, and a platform 1070), a frame assembly 1100, and an exercise tracking system 1300, which is the same as or similar to the first assembly, shown as stair and slide assembly 20, 420, the second assembly, shown as frame assembly 100, 500, and the control system, shown as exercise tracking system 300 described herein with respect to the exercise apparatus 10, 400. As described herein, the exercise apparatus 1000 may be transported and easily assembled.

Figure 33:
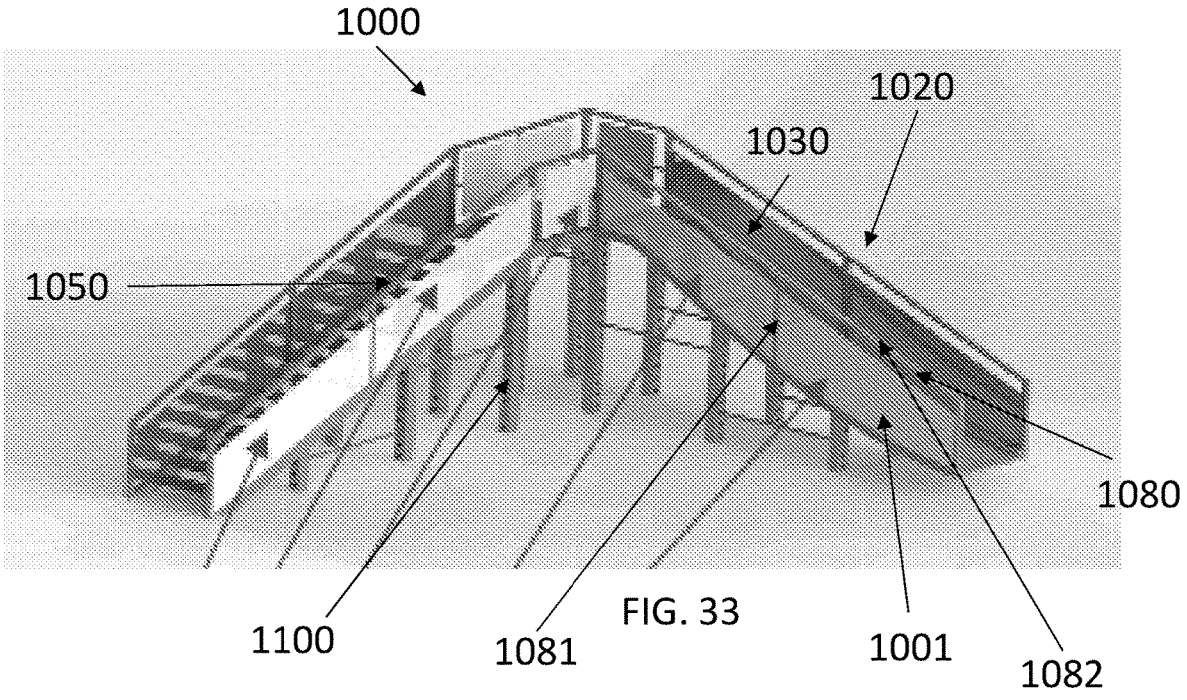
Figure 34:
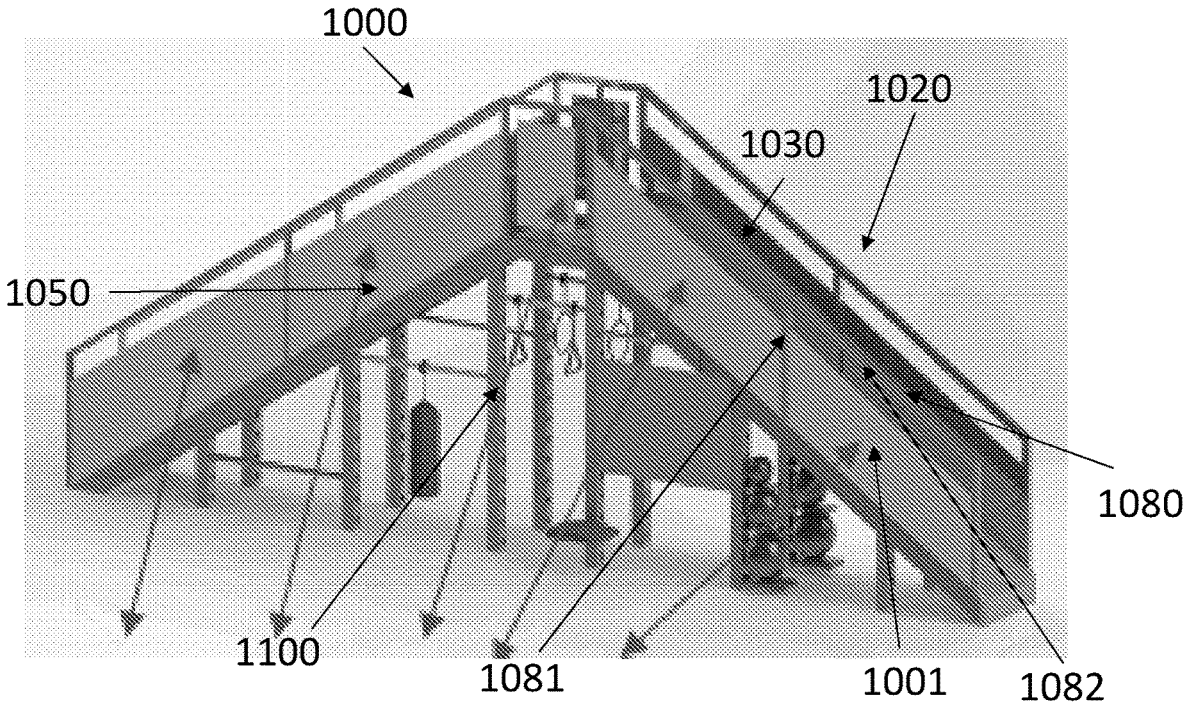
Figure 35:
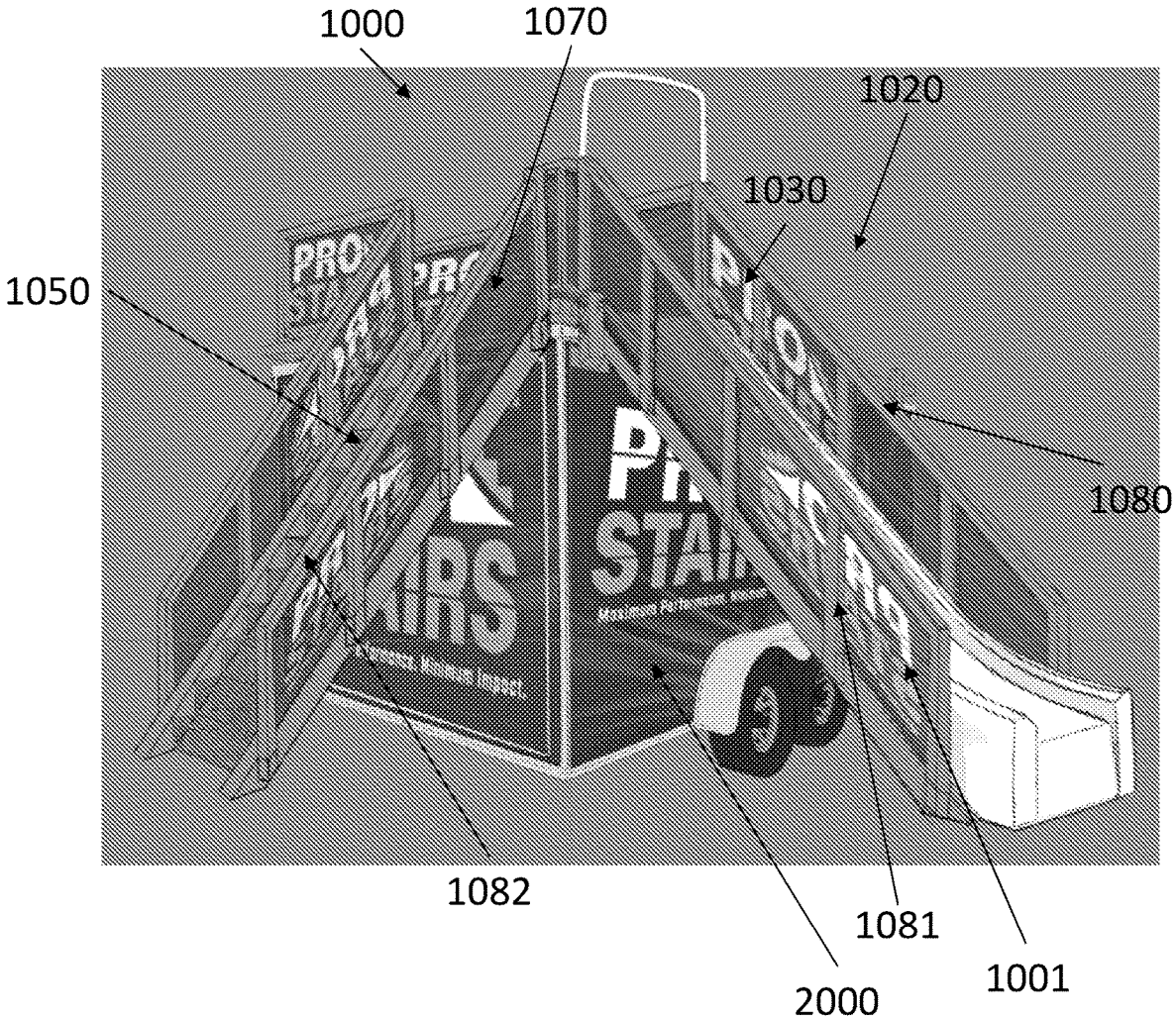
Figure 36:
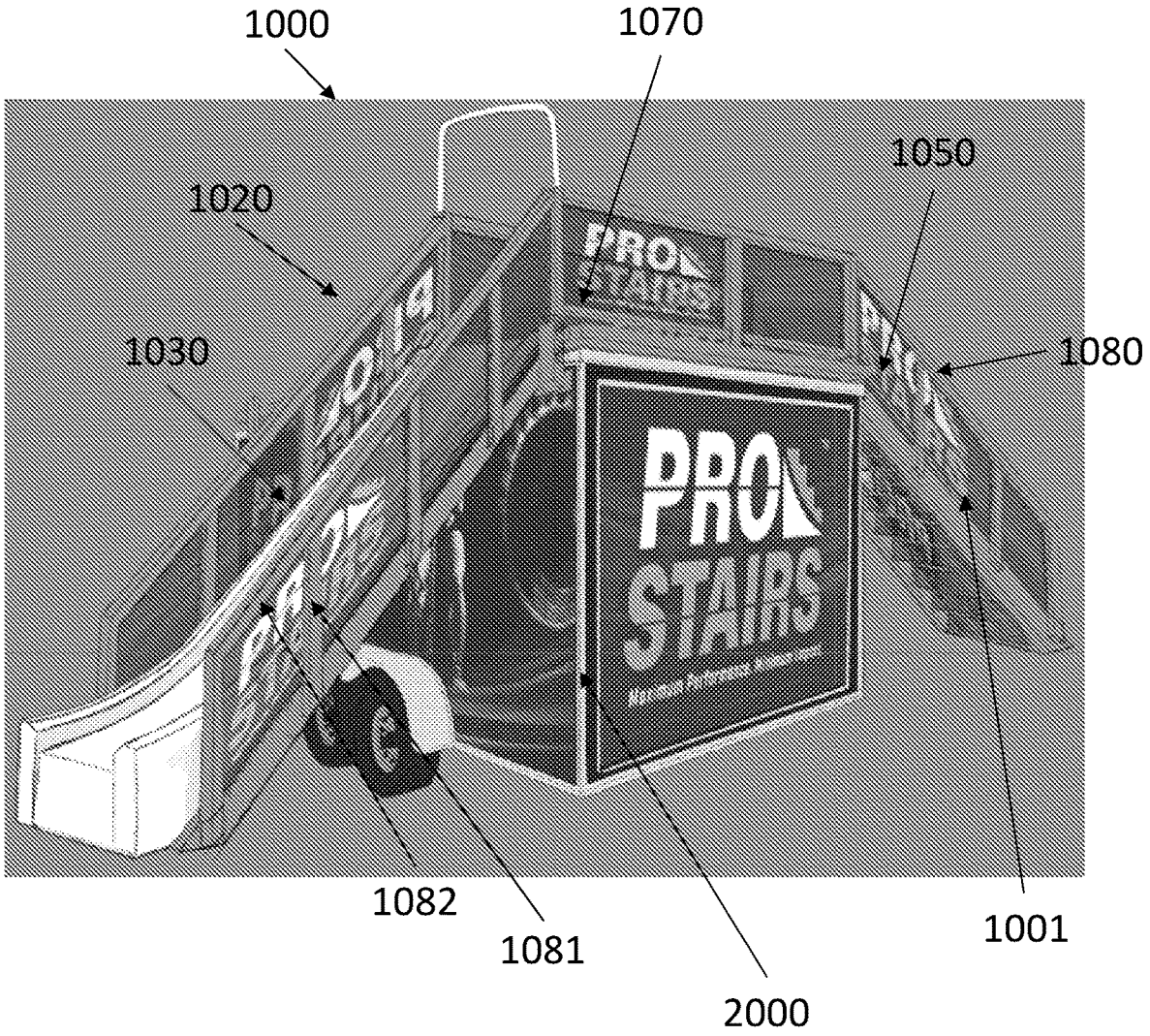
Figure 37:
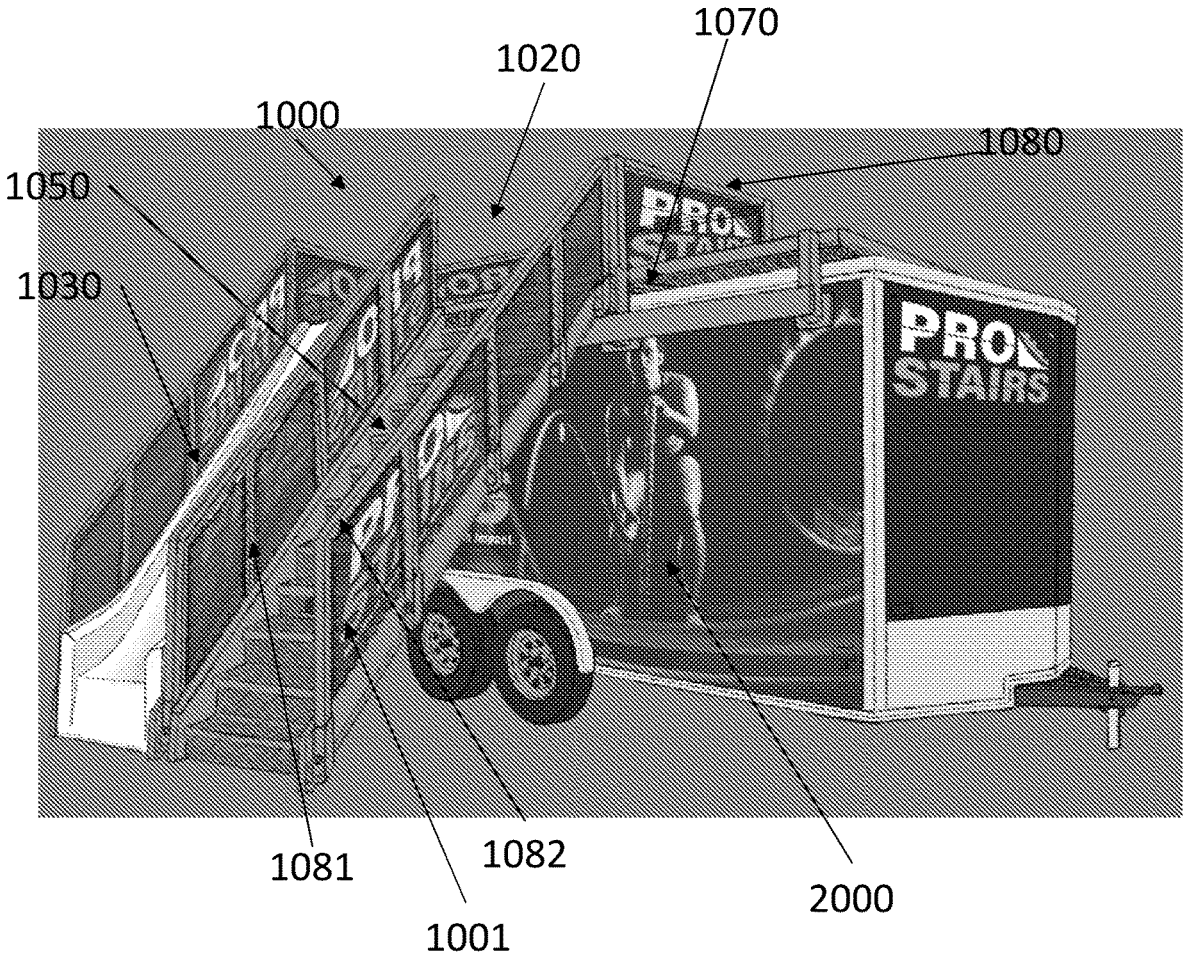

Referring to FIGS. 35-37, FIGS. 35-37 illustrate an example of the exercise apparatus 1000, which may include the same features, properties, and/or components as the exercise apparatus 1000 shown in FIGS. 31-34. The exercise apparatus 1000 may include a mobile exercise apparatus in which the exercise apparatus 1000 includes a mobile support unit 2000. The mobile support unit 2000 may include a vehicle, a portion of a vehicle, a trailer coupleable to and/or towable by a vehicle, and/or another moveable support unit. The mobile support unit 2000 allows the exercise apparatus 1000, including the stair and slide assembly 1020 (including the stair apparatus 1030, the slide apparatus 1050, and the platform 1070) to be easily transported and easily assembled. In some implementations, mobile support unit 2000, such as a roof of the mobile support unit 2000, may be and/or otherwise include the platform 1070. The mobile support unit 2000 may allow for the exercise apparatus to be assembled and supported by the mobile support unit 2000 during transportation, and/or when the mobile support unit 2000 is stationary. In some implementations, the mobile support unit 2000 is customized to support, store, and/or transport the platform 1070. In other implementations, the mobile support unit 2000 includes an "off-the-shelf trailer." Some implementations relate to methods of making or constructing a mobile support unit. Such implementations can include incorporating an off-the shelf or commercially available unit and modifying it, for example, to have a top that can function as a platform as described herein, to be attached to a slide, stair, platform, side rail/hand rail, and/or other component, etc. In other embodiments, the mobile support unit may be a customized or built for the purpose of use as a mobile support unit. The mobile support unit 2000 may be of any size to be able to contain the exercise apparatus inside the cargo portion of the mobile support unit. The apparatus can be modularized to fit in trailers of various sizes. For example, the mobile support unit 2000 may be approximately 5 to 10 feet long, 10 to 15 feet long, 16 to 20 feet long, or greater, 1 to 5 feet wide, 5 to 10 feet wide, 10 to 15 feet wide, 16 to 20 feet wide, or greater, and/or 1 to 5 feet tall, to 10 feet tall, 10 to 15 feet tall, 16 to 20 feet tall, or greater. In some implementations, the mobile support unit 2000 is approximately 16 feet long, 6 feet tall, and 5 to 6 feet wide. In use, the mobile support unit 2000, such as the platform 1070 may be raised approximately 7 feet, 1 to 3 feet, 3 to 6 feet, 6 to 9 feet, 9 to 12 feet, or greater, off the ground. In some aspects, the mobile support unit can have one or more exercise devices, exercise equipment, and storage devices attached to the mobile unit, for example, in addition to the stair and slide assembly.

Some implementations relate to methods, components, parts, modules and apparatus for exercising, supporting exercise apparatus, transporting and/or storing an exercise apparatus that includes the use of a mobile support unit and/or the other apparatuses as described herein, including the stand alone/non-mobile exercise apparatuses as described herein.

In some implementations, one or more of the components of the stair and slide assembly 1020 and/or the frame assembly 1100 may be attachable and/or detachable from the mobile support unit 2000. In some implementations, as noted above, the platform 1070 forms the top of the mobile support unit 2000 and/or may be coupled to the top of the mobile support unit 2000. Thus, one or more of the components of the stair and slide assembly 1020, such as the stair apparatus 1030, the slide apparatus 1050, and the platform 1070 and/or the frame assembly 1100 may be coupleable directly or indirectly to the mobile support unit 2000 and/or to the platform 1070. In some implementations, the platform 1070 may include one, two, three, four, five, or more modular detachable and/or attachable components. The platform 1070 may include one, two, or more 48 inch×48 components (though other sizes are contemplated), which would accommodate a 48 inch wide slide apparatus 1030 (for example) and/or stair apparatus 1050, for example. The platform 1070 could be any other size as well to accommodate the sizes of the other parts, including approximately 48 inches by 60 inches, 72 inches, 84 inches, 96 inches, and/or the like, and/or approximately 36 inches by 48 inches, 60 inches, 72 inches, 84 inches, 96 inches, and/or the like or any ranges there between, lesser, or greater.

As described herein, the exercise apparatus 1000 according to any of the embodiments can be highly modular. For example, one or more components of the slide and stair assembly 1020, such as the stair apparatus 1030, the slide apparatus 1050, and/or the platform 1070, and/or one or more components of the frame assembly 1100 may form modular components and/or may include one, two, three, four, five, or more modular components for easier transportation and improved portability. Additionally, the exercise apparatus 1000 can include one or exercise devices, exercise equipment, and storage devices as described herein.

In some implementations, the stair and slide assembly 1020 includes a railing, shown as hand rail 1080. The hand rail 1080 may be detachable from the stair apparatus 1030, the slide apparatus 1050, and/or the platform 1070. In some implementations, hand rail 1080 may form one, two, three, four, five, or more components to more easily transport, store, and/or carry. In some implementations, the hand rail 1080 may be broken into two, three, four, or more sections.

Additionally and/or alternatively, the hand rail 1080 may include two long rail members 1082 which are attached to vertical members 1081 coupled to the slide and stair assembly 1020. The vertical members 1081 may detach from the horizontal members 1082 of the hand rail 1080. In some implementations, the vertical members 1081 fold to be approximately parallel with the longer horizontal members

1082 during transport. Thus, during transport, for example, a top horizontal rail member 1082 may include the vertical members 1081 folded to be approximately parallel to the horizontal members 1082, and the other horizontal member 1082 that is not attached to the vertical members 1081 may not include the vertical members 1081. Additionally and/or alternatively, the side of the stair apparatus 1030 and/or the slide apparatus 1050 may act as a bottom horizontal rail component that the vertical members 1081 are attached to when the exercise apparatus is assembled. These are just non-limiting examples of configurations and ways to have the hand rail be modular. In some embodiments the hand rails can be of a solid or unitary material and/or can include more or fewer vertical members and/or horizontal members.

Additionally, and/or alternatively, one or more configurations of the exercise apparatus 1000 may include one, two, or more stair apparatus 1050 and one, two, or more slide apparatus 1030. In such implementations, one or more of the slide apparatus 1030 may be positioned on (e.g., sit on, couple to, etc.) one or more of the stair apparatus 1050. In this implementation, the slide apparatus 1030 positioned on the stair apparatus 1050 may act as a bottom horizontal rail component for attachment to the vertical members when the exercise apparatus 1000 is assembled.

In some implementations, the mobile support unit 2000 may include a stabilizing feature. The stabilizing feature may stabilize and/or level the exercise apparatus 1000 when supported by the mobile support unit 2000. For example, the stabilizing feature can be jack like legs that can be raised and lowered that can provide support against unwanted movement and/or leveling of the support unit.

As described herein, the exercise apparatus may include one or more configurations that may be used in a variety of locations. For example, FIG. 35 illustrates an example in which the slide apparatus 1030 is positioned at a 90 degree angle relative to the stair apparatus 1050. FIG. 36 illustrates another example, in which the slide apparatus 1030 is positioned at a 180 degree angle relative to the stair apparatus 1050. FIG. 37 illustrates an example in which the slide apparatus 1030 is positioned approximately parallel and adjacent to the stair apparatus 1050. Other configurations are also contemplated in which the slide apparatus 1030 is positioned at a 20 to 30 degree, 45 degree, 50 to 90 degree, 90 to 120 degree, 120 degree, 135 degree, 135 to 150 degree, 150 to 180 degree angle and/or other ranges there between, relative to the stair apparatus 1050. In the example configurations shown in FIGS. 35-37, for example, the platform 1070 is coupled to and/or forms the top of the mobile support unit 2000. Additionally and/or alternatively, the frame assembly may form the mobile support unit 2000.

As noted above, the exercise apparatus 1000 may additionally and/or alternatively be a standalone unit that is not supported by the mobile support unit 2000. Rather, the exercise apparatus 1000 may be supported by the frame assembly 1100, which rests on and/or is coupled to the ground. FIGS. 31-34 illustrate configurations, consistent with implementations of the current subject matter in which the exercise apparatus 1000 is a standalone unit. As noted above, the exercise apparatus 1000 is highly modularized for easy transport. The components of the exercise apparatus 1000 including the standalone unit, may be configured to fit within the mobile support unit 2000. Additionally and/or alternatively, at least some or all of the modular components of the exercise apparatus 1000 may fit within 3 to 4, 1 to 2, 2 to 4, 4 to 6, 6 to 8, 8 to 10, 1 to 10, 1 to 5 and/or more storage units, such as crates, which may be carried by a single user, or in some instances multiple users. The crates may be configured to fit within a standard doorway, and/or a doorway that is approximately 36 inches, 34 inches, 34 to 36 inches, 36 to 40 inches wide and/or other ranges there between or greater. Thus, the crates may fit through a single doorway rather than require the use of bay doors, double doors, and/or the like, for easier transport and improved portability.

In some implementations, the crates are approximately 36 inches wide, 34 inches, 34 to 36 inches, 36 to 40 inches wide, 10 to 36 inches wide, 1 to 30 inches wide, 1 to 48 inches wide (or any value there between), and/or other ranges there between, lesser, or greater. In some implementations, the crates are 34 to 35 inches deep, 10 to 30 inches deep, 10 to 20 inches deep, 20 to 30 inches deep, 20 to 25 inches deep, 25 to 30 inches deep, 30 to 35 inches deep, 35 to 40 inches deep, 40 to 45 inches deep, and/or other ranges there between, lesser, or greater. In some implementations, the crates are 36 to 38.5 inches tall, 10 to 30 inches tall, 10 to 20 inches tall, 20 to 30 inches tall, 20 to 25 inches tall, 25 to 30 inches tall, 30 to 35 inches tall, 35 to 40 inches tall, 40 to 45 inches tall, and/or other ranges there between, lesser, or greater. The one or more crates may additionally and/or alternatively include one or more wheels to allow for the crates to be moved and/or slid by a single user.

Figure 31:
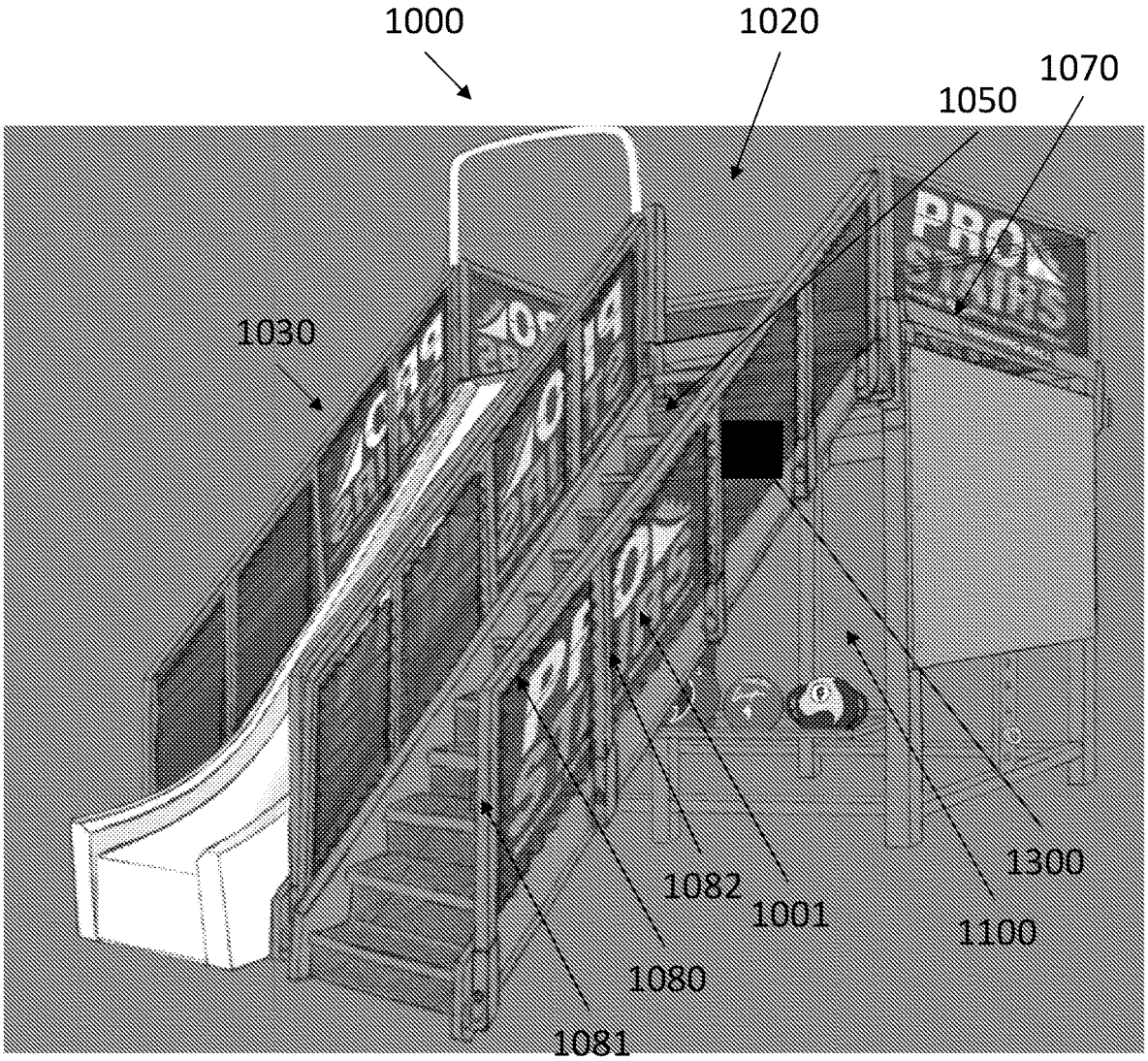
FIGS. 31-37 are various views of an exercise apparatus, according to an example embodiment of the current subject matter.
Figure 32:
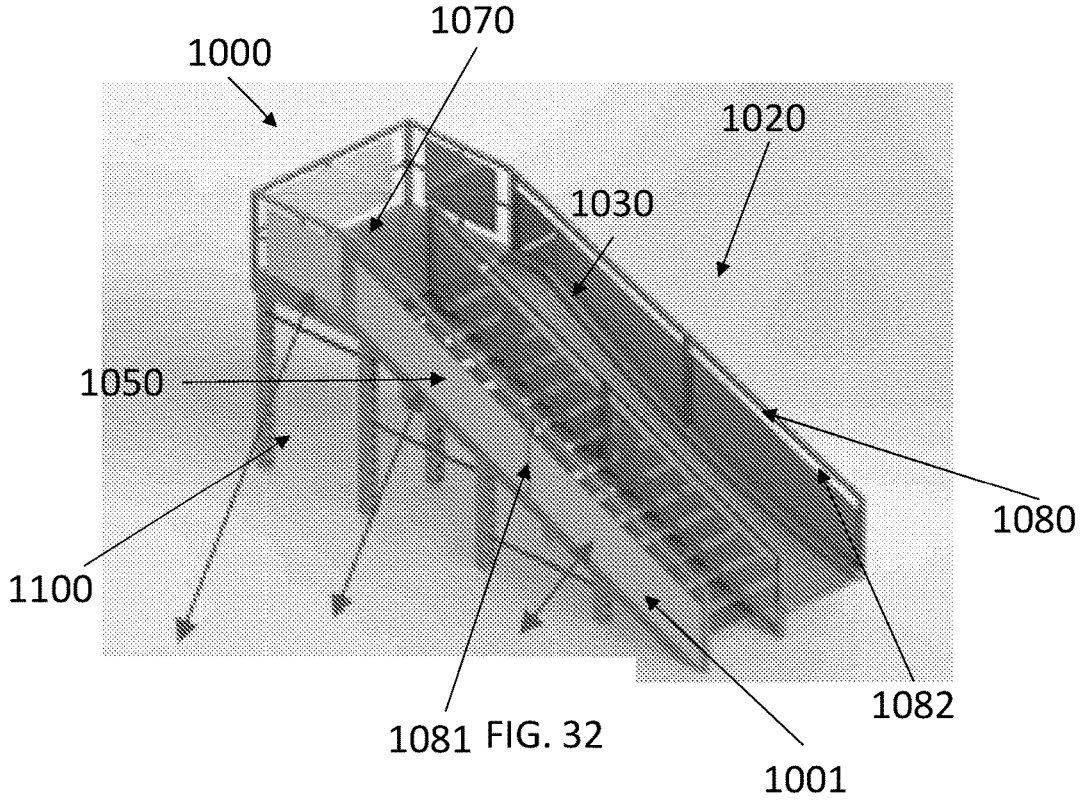

As described herein, the exercise apparatus may include one or more configurations that may be used in a variety of locations. For example, FIG. 33 illustrates an example in which the slide apparatus 1030 is positioned at a 90 degree angle relative to the stair apparatus 1050. FIG. 34 illustrates another example, in which the slide apparatus 1030 is positioned at a 180 degree angle relative to the stair apparatus 1050. FIG. 31 and FIG. 32 illustrate examples in which the slide apparatus 1030 is positioned approximately parallel and adjacent to the stair apparatus 1050. Other configurations are also contemplated in which the slide apparatus 1030 is positioned at a 20 to 30 degree, 45 degree, 50 to 90 degree, 90 to 120 degree, 120 degree, 135 degree, 135 to 150 degree, 150 to 180 degree angle and/or other ranges there between, relative to the stair apparatus 1050.

As shown in FIGS. 31-37, the exercise apparatus 1000 includes one or more side panels 1001, which are supported by one or more vertical members 1081 of the hand rail 1080 and/or one or more horizontal members 1082 of the hand rail 1080. The one or more side panels 1080 may be made of mesh, cloth, plastic, fiberglass, aluminum, ribbing, and/or the like. The one or more side panels 1080 may be transparent. The one or more side panels 1080 may be made at least in part or wholly of the same material as the horizontal and vertical members. The one or more side panels may be made of a lightweight material to improve the portability of the exercise apparatus 1000. The one or more side panels 1001 may additionally and/or alternatively be configured to receive one or more posters, signs, advertisements and/or the like.

One or more components of the exercise apparatus 1000 may be made of a lightweight material, such as metal, fiberglass, plastic, composite, cloth, mesh, and/or the like to improve the overall portability of the apparatus, while maintaining its structural integrity in use. It is important to note that the construction and arrangement of the elements of the systems, methods, and/or apparatuses as shown in the example embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the goggle may be constructed from any of a wide variety of materials that provide sufficient strength or durability, in any of a wide variety of colors, textures, and combinations.

Embodiments have been described in connection with the accompanying drawings. However, it should be understood that the figures are not drawn to scale. Distances, angles, shapes, etc. are merely illustrative and do not necessarily bear an exact relationship to actual dimensions and layout of the articles that are illustrated. In addition, the foregoing embodiments have been described at a level of detail to allow one of ordinary skill in the art to make and use the articles, parts, different materials, etc. described herein. A wide variety of variation is possible. Articles, materials, elements, and/or steps can be altered, added, removed, or rearranged. While certain embodiments have been explicitly described, other embodiments will become apparent to those of ordinary skill in the art based on this disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or configurations are in any way required for one or more embodiments. The terms "comprising," "including," "having," and the like are synonymous and are used inclusively, in an open-ended fashion, and do not exclude additional elements, features, acts, operations, and so forth. The term "consisting essentially of" can be used anywhere where the terms comprising, including, containing or having are used herein, but consistent essentially of is intended to mean that the claim scope covers or is limited to the specified materials or steps recited and those that do not materially affect the basic and novel characteristic(s) of the claimed invention. Also, the term "consisting of" can be used anywhere where the terms comprising, including, containing or having are used herein, but consistent of excludes any element, step, or ingredient not specified in a given claim where it is used.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, in the subject description, the word "example" is used to mean serving as an example, instance, or illustration. Any embodiment or design described herein as "example" is not necessarily to be construed as preferred or advantageous over other embodiments or designs. Rather, use of the word example is intended to present concepts in a concrete manner. Accordingly, all such modifications are intended to be included within the scope of the present inventions. Other substitutions, modifications, changes, and omissions may be made in the design, operating conditions, and arrangement of the preferred and other example embodiments without departing from scope of the present disclosure or from the spirit of the appended claims.

What is claimed is:

1. A mobile exercise apparatus, comprising:

a plurality of modular exercise components comprising:

a platform;

a modular stair portion comprising a plurality of stairs, the modular stair portion configured to be removably coupled to the platform;

a modular slide portion comprising a slide, the modular slide portion configured to be removably coupled to the platform, the modular stair portion and the modular slide portion removably attachable to the platform in a first alignment configuration forming a first angle therebetween, the modular stair portion and the modular slide portion removably attachable to the platform in a second alignment configuration forming a second angle therebetween, the first angle being different than the second angle, wherein an angle formed between the modular stair portion and the modular slide portion when both are coupled to the platform is adjustable by detaching at least one of the modular stair portion and the modular slide portion from the platform at a first point of attachment and recoupling at least one of the modular stair portion and the modular slide portion to the platform at a second point of attachment;

a mobile support unit configured to support the plurality of modular exercise components, the mobile support unit further configured to be coupled to a vehicle to transport the plurality of modular exercise components; and a frame positioned to engage with and support the modular stair portion or the modular slide portion, wherein the frame comprises a plurality of adjustable feet configured to adjust the angle of the modular stair portion or the modular slide portion relative to a nominal angle of the modular stair portion or a nominal angle of the modular slide portion.

2. The mobile exercise apparatus of claim 1, wherein the mobile support unit defines at least a portion of the platform.

3. The mobile exercise apparatus of claim 1, wherein a top of the mobile support unit comprises the platform.

4. The mobile exercise apparatus of claim 1, wherein the platform is configured to be coupled to a top of the mobile support unit.

5. The mobile exercise apparatus of claim 1, wherein the mobile support unit forms a trailer comprising a plurality of wheels configured to allow the mobile support unit to be transported.

6. The mobile exercise apparatus of claim 1, wherein the mobile support unit comprises an interior volume; and wherein the interior volume is configured to store the modular stair portion and the modular slide portion when the plurality of modular exercise components are transported by the mobile support unit.

7. The mobile exercise apparatus of claim 1, further comprising a detachable handrail, the detachable handrail comprising a plurality of horizontal members and a plurality of vertical members configured to support the plurality of horizontal members.

8. The mobile exercise apparatus of claim 7, wherein the plurality of vertical members are configured to be folded to be parallel with the plurality of horizontal members during transport of the plurality of modular exercise components.

9. The mobile exercise apparatus of claim 7, wherein the slide portion is configured to be positioned on the modular stair portion, the slide portion comprising a bottom horizontal member for attachment to the plurality of vertical members.

10. The mobile exercise apparatus of claim 1, wherein the mobile support unit is configured to stabilize the plurality of modular exercise components when the plurality of modular exercise components are supported by the mobile support unit.

11. A modular exercise apparatus comprising a plurality of modular exercise components configured to be removably coupled to one another, the plurality of modular exercise components comprising:

a platform;

a modular stair portion comprising a plurality of stairs, the modular stair portion configured to be removably coupled to the platform;

a modular slide portion comprising a slide, the modular slide portion configured to be removably coupled to the platform, wherein an angle between the modular stair portion and the modular slide portion is adjustable by removing at least one of the modular stair portion and the modular slide portion from the apparatus and recoupling at least the modular stair portion or the modular slide portion to the modular exercise apparatus; and a frame positioned to engage with and support the modular stair portion or the modular slide portion, wherein the frame comprises a plurality of adjustable feet configured to adjust the angle of the modular stair portion or the modular slide portion relative to a nominal angle of the modular stair portion or a nominal angle of the modular slide portion.

12. The modular exercise apparatus of claim 11, wherein the plurality of modular exercise components are configured to be coupled to a mobile support unit, the mobile support unit configured to support the plurality of modular exercise components, the mobile support unit further configured to be coupled to a vehicle to transport the plurality of modular exercise components.

13. The modular exercise apparatus of claim 11, further comprising a detachable handrail, the detachable handrail comprising a plurality of horizontal members and a plurality of vertical members configured to support the plurality of horizontal members.

14. The modular exercise apparatus of claim 13, wherein the plurality of vertical members are configured to be folded to be parallel with the plurality of horizontal members during transport of the plurality of modular exercise components.

15. The modular exercise apparatus of claim 11, wherein the modular stair portion is positioned at a 90-degree angle relative to the modular slide portion.

16. The modular exercise apparatus of claim 11, wherein the modular stair portion is positioned at a 180-degree angle relative to the modular slide portion.

17. The modular exercise apparatus of claim 11, wherein the modular stair portion is positioned parallel to the modular slide portion.

18. The modular exercise apparatus of claim 11, wherein the modular slide portion and the modular stair portion are stackable relative to one another.

19. The modular exercise apparatus of claim 11, wherein the modular slide portion and the modular stair portion are each foldable.

* * * * *